US007776501B2

(12) United States Patent
Tamura et al.

(10) Patent No.: US 7,776,501 B2
(45) Date of Patent: Aug. 17, 2010

(54) COLOR TONER

(75) Inventors: Shigeto Tamura, Suntou-gun (JP); Takaaki Kaya, Suntou-gun (JP); Ryoichi Fujita, Chofu (JP); Makoto Kambayashi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/245,440

(22) Filed: Oct. 3, 2008

(65) Prior Publication Data

US 2009/0035685 A1 Feb. 5, 2009

Related U.S. Application Data

(63) Continuation of application No. PCT/JP2008/061154, filed on Jun. 18, 2008.

(30) Foreign Application Priority Data

Jun. 19, 2007 (JP) ..... 2007-161267

(51) Int. Cl.
*G03G 9/087* (2006.01)
*G03G 9/093* (2006.01)

(52) U.S. Cl. ..... 430/109.4; 430/110.2; 430/137.11

(58) Field of Classification Search ..... 430/110.2, 430/109.4, 137.11
See application file for complete search history.

(56) References Cited

U.S. PATENT DOCUMENTS

| | | | | |
|---|---|---|---|---|
| 6,300,024 | B1 | 10/2001 | Yusa et al. | |
| 2006/0210899 | A1 | 9/2006 | Nakazawa et al. | 430/106.1 |
| 2007/0048647 | A1* | 3/2007 | Daimon et al. | 430/110.2 |
| 2009/0170021 | A1 | 7/2009 | Kaya et al. | 430/109.4 |
| 2009/0263738 | A1 | 10/2009 | Kaya et al. | 430/108.2 |

OTHER PUBLICATIONS

Japanese Patent Office machine-translation of JP06-175390 (pub. Jun. 1994).*
Japanese Patent Office machine-translation of JP2002-099110 (pub. Apr. 2002).*
Japanese Patent Office English-language abstract describing JP2002-169336 (pub. Jun. 2002).*
Japanese Patent Office machine-translation of JP2004-354706 (pub. Dec. 2004).*
Japanese Patent Office English-language abstract describing JP2006-257950 (pub. Sep. 2006).*
Japanese Patent Office machine-translation of JP2004-191927 (pub. Jul. 2004).*
Japanese Patent Office machine-translation of JP2002-091078 (pub. Mar. 2002).*
Japanese Patent Office machine-translation of JP2004-198692 (pub. Jul. 2004).
Japanese Patent Office machine-translation of JP2006-206848 (pub. Aug. 2006).
Japanese Patent Off. machine-translation of JP2007-121462 (pub. May 2007).
Japanese Patent Office machine-translation of JP08-006288 (pub. Jan. 1996).
Japanese Patent Office machine-translation of JP2006-267950 (pub. Oct. 2006).

* cited by examiner

*Primary Examiner*—Janis L Dote
(74) *Attorney, Agent, or Firm*—Fitzpatrick, Cella, Harper & Scinto

(57) ABSTRACT

The color toner has capsule type toner particles each having a surface layer (B) mainly formed of a resin (b) on the surface of a toner base particle (A) containing at least a binder resin (a), a colorant, and a wax, in which (1) a temperature Tp at which a curve 1 obtained by plotting a temperature on an axis of abscissa and the common logarithm of a value obtained by dividing the loss modulus G" of the color toner by the unit of the loss modulus on an axis of ordinate shows a maximum is present, and Tp satisfies the relationship of 40° C.≦Tp≦60° C., (2) a temperature Ts at which a curve 2 obtained by differentiating the curve 1 with respect to the temperature twice shows a local minimum is present in the temperature range of Tp+10(° C.) to Tp+40(° C.), and (3) a ratio G"(Ts)/G"(Ts+5) in the curve 1 is larger than 3.0.

6 Claims, 3 Drawing Sheets

COLOR TONER

FIELD OF THE INVENTION

The present invention relates to a color toner for use in a recording method employing an electrophotographic method, an electrostatic recording method, or a toner jet system recording method, and more specifically, to a color toner for use in a printing machine, copying machine, printer, or facsimile, which forms a toner image on an electrostatic latent image bearing member in advance, transfers the toner image onto a transfer material to form an image, and fixes the transferred image under heat and pressure to provide an image.

BACKGROUND OF THE INVENTION

An electrophotographic method is as described below. A photoconductive substance is utilized so that an electric latent image is formed on an image bearing member (photosensitive member) with various means. Next, a toner image is formed by developing the latent image with toner, and the toner image formed with the toner is transferred onto a transfer material such as paper as required. After that, the toner image is fixed, onto the transfer material with heat and pressure, whereby a recording medium is obtained.

Properties requested of an electrophotographic apparatus have become more and more sophisticated in recent years, and examples of the properties include:

(1) an increase in speed at which the apparatus outputs an image;
(2) an improvement in image quality to respond to a request for a high-resolution, high-definition image;
(3) stability with which high image quality can be prevented from being impaired over a long time period;
(4) high color reproducibility; and
(5) the achievement of energy savings such as a lower power consumption.

A high-productivity electrophotographic apparatus has been attracting attention in recent years because of its potential to supersede an offset printing apparatus. High levels of techniques are requested of the high-productivity electrophotographic apparatus which outputs high-quality color images stably at a high speed. In view of the foregoing, the improvement of an image processing portion, the improvement of an electrophotographic process, and the improvement of a material for the apparatus have been continued; the improvement of toner with which an image is formed, is also important.

Toner based on a pulverization method excellent in low-temperature fixability has been conventionally developed in a vigorous fashion and marketed as toner for high-productivity electrophotographic apparatuses. However, the toner based on a pulverization method involves the following problem: a resin to be used in the toner must be selected from resins each excel lent in heat-resistant storage stability, so the number of resin alternatives is small, and a drastic improvement in low-temperature fixability of the toner is hardly achieved. Further, the toner involves the following problem: upon sharpening of the particle size distribution of the toner for the acquisition of high developing performance, the yield in which the toner is produced reduces, or an additionally large number of production steps for the toner are needed.

In addition, a particle of the pulverized toner is of an amorphous shape, so the toner may be additionally pulverized by stirring or a contact stress in a developing device when the toner is used in a high-speed, high-productivity apparatus. As a result, the following situation may arise: the generation of a fine powder of the order of submicrons, the exposure of a wax, and the embedment of a flowability-imparting agent in the surface of the toner occur, so the quality of an image formed with the toner reduces.

Meanwhile, a reduction in particle diameter of toner has been advanced with a view to improving resolution and definition, and, at the same time, spherical toner has started to be suitably used with a view to improving transfer efficiency and flowability.

In addition, a wet method has started to be preferably employed as a method of efficiently preparing spherical toner particles each having a small particle diameter.

A conventional wet method has been a method of preparing toner particles on the basis of a polymerization method such as a suspension polymerization method or an emulsion polymerization method. Meanwhile, one conventionally known effective method is the following approach: the sharp melt property of the binder resin of toner is improved so that an image formed with the toner can be fixed at an additionally low temperature. However, each of the above polymerization methods involves the following problem: the binder resin of the toner is limited to a vinyl resin.

In view of the foregoing, JP 2004-198692 A and JP 2002-169336 A each propose, as a wet method, a dissolution suspension method involving: dissolving a resin component in an organic solvent immiscible with water; and dispersing the solution in an aqueous phase to form oil droplets so that spherical toner particles are produced. The approach can easily provide spherical toner particles each using a polyester resin excellent in low-temperature fixability as a binder resin and each having a small particle diameter. However, the method may involve the emergence of a problem similar to that in the case of such pulverized toner as described above because the surface layer of each toner particle is apt to peel from the toner base particle of the particle so as to serve as a fine powder.

JP 2004-354706 A discloses a toner using a polyester resin having a relatively low softening point as a core and a vinyl resin having a high softening point relative to that of the core as a shell. When a capsule type toner the core and shell of which are formed of different materials as described above is used in a high-productivity apparatus, the following problem is apt to occur: a surface layer (B) is apt to peel from a toner base particle (A), and the surface layer serves as a fine powder to reduce the durable stability of the toner.

JP 2006-206848 A discloses a core-shell type resin particle excellent in charging characteristic, heat-resistant storage stability, and heat characteristic, and the particle can be used in toner. However, there is still room for investigation on a preferable combination of a core and a shell for the achievement of compatibility between excellent low-temperature fixability and heat-resistant storage stability.

SUMMARY OF THE INVENTION

Problems to be Solved by the Invention

An object of the present invention is to provide a color toner capable of achieving compatibility between heat-resistant storage stability and low-temperature fixability.

Means for Solving the Problems

A color toner including capsule, type toner particles each having a surface layer (B) mainly formed of a resin (b) on a surface of a toner base particle (A) containing at least a binder resin (a), a colorant, and a wax, in which:

(1) a temperature Tp at which a curve 1 obtained by plotting a temperature (° C.) on an axis of abscissa and a common logarithm (logG") of a value obtained by dividing a loss modulus G" (Pa) of the color toner by a unit (Pa) of the loss modulus on an axis of ordinate shows a maximum is present, and Tp satisfies a relationship of 40° C.≦Tp≦60° C.;

(2) a temperature Ts at which a curve 2 obtained by differentiating the curve 1 with respect to the temperature twice shows a local minimum is present in a temperature range of Tp+10(° C.) to Tp+40(° C.); and (3) when the loss modulus G" at the temperature Ts in the curve 1 is represented by G" (Ts) and the loss modulus G" at a temperature higher than the temperature Ts by 5° C. in the curve 1 is represented by G" (Ts+5), a ratio G" (Ts)/G" (Ts+5) is larger than 3.0.

Effects of the Invention

According to a preferred aspect of the color toner of the present invention, the color toner of the present invention is a color toner having capsule type toner particles each having the toner base particle (A) and the surface layer (B), the color toner being capable of exerting excellent performance as a result of such functional separation that the toner base particle (A) is provided with functions such as a low viscosity, releasing performance, and coloring and the surface layer (B) is provided with functions such as heat-resistant storage stability and charging performance involved in developing performance.

The binder resin (a) preferably has such a characteristic as to melt at a low temperature, and, if so, it will be able to fix the toner at an additionally low temperature. On the other hand, the resin (b) of which the surface layer (B) is formed preferably has such a characteristic that the resin hardly melts at a typical temperature at which the toner is stored, but immediately melts by heating, and, if so, the toner will exert excellent heat-resistant storage stability and excellent low-temperature fixability.

A capsule type toner structure in which the materials of which the toner base particle (A) and the surface layer (B) are formed have different melt characteristics as described above can exert excellent low-temperature fixability while satisfying heat-resistant storage stability.

In the present invention, compatibility between low-temperature fixability and heat-resistant storage stability can be achieved when the color toner has the above viscoelasticity.

BEST MODE FOR CARRYING OUT THE INVENTION

Figure 1:
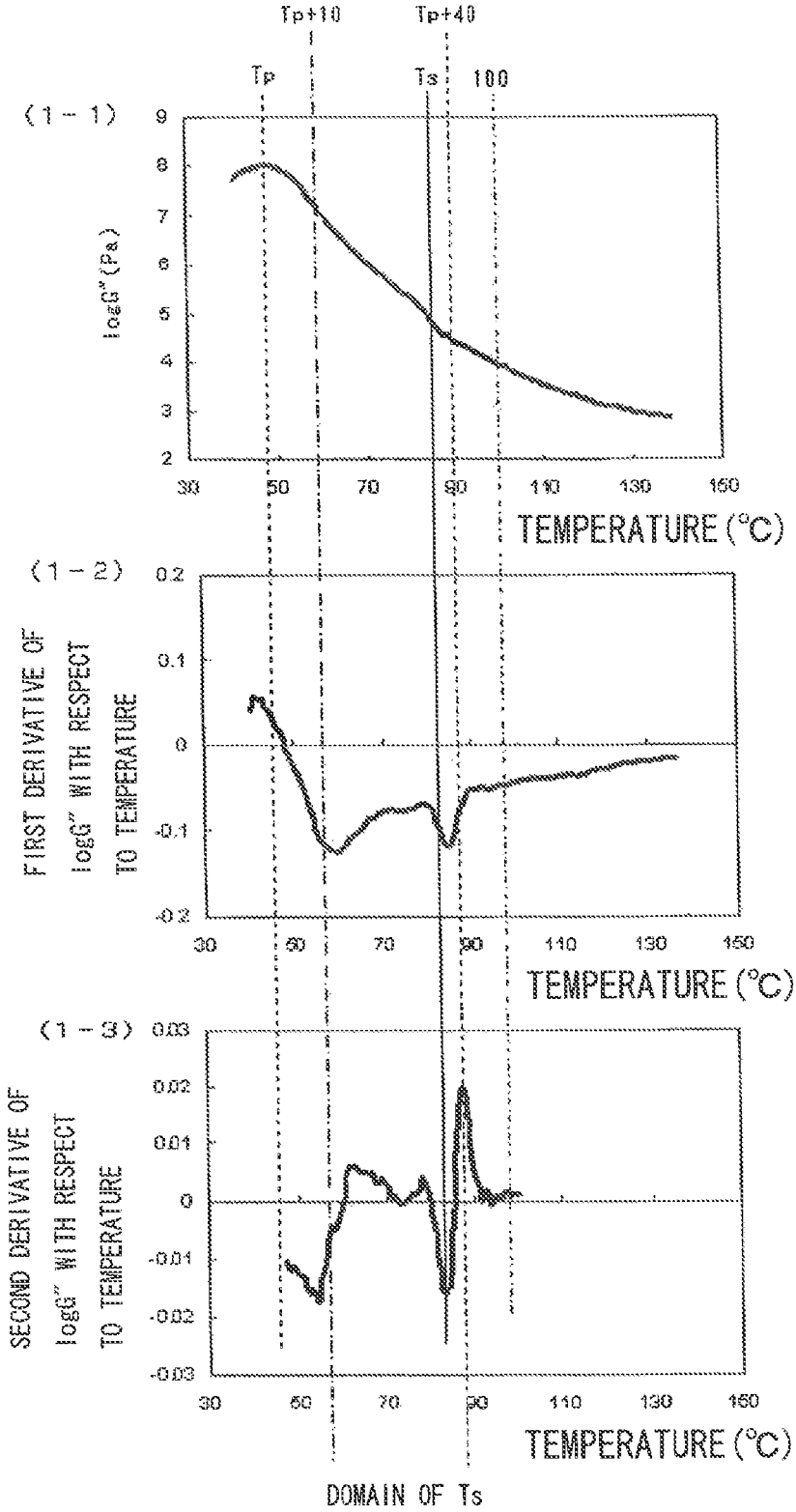
FIG. 1(1-1) shows a curve 1 (G" plotted, versus a temperature) obtained by smoothly connecting the results of the measurement of the dynamic viscoelasticity of a toner, FIG. 1(1-2) shows a result obtained by differentiating (1-1) with respect to the temperature once, and FIG. 1(1-3) shows a result obtained by differentiating (1-1) with respect to the temperature twice.

A color toner of the present invention includes capsule type toner particles each having a surface layer (B) mainly formed of a resin (b) on a surface of a toner base particle (A) containing at least a binder resin (a), a colorant, and a wax, and satisfies the following conditions (1) to (3):

(1) a temperature Tp at which a curve 1 obtained by plotting a temperature (° C.) on an axis of abscissa and a common logarithm (log G") of a value obtained by dividing a loss modulus G" (Pa) of the color toner by a unit (Pa) of the loss modulus on an axis of ordinate shows a maximum is present, and Tp satisfies a relationship of 40° C.≦Tp≦60° C.;

(2) a temperature Ts at which a curve 2 obtained by differentiating the curve 1 with respect to the temperature twice shows a local minimum is present in a temperature range of Tp+10(° C.) to Tp+40(° C.); and (3) when the loss modulus G" at the temperature Ts in the curve 1 is represented by G" (Ts) and the loss modulus G" at a temperature higher than the temperature Ts by 5° C. in the curve 1 is represented by G" (Ts+5), a ratio G" (Ts)/G" (Ts+5) is larger than 3.0.

The characteristic of the loss modulus (G") of the color toner of the present invention will be described with reference to (1-1), (1-2), and (1-3) of FIG. 1. (1-1) shows a temperature (° C.) on an axis of abscissa and the common logarithm of a non-dimensional value obtained by dividing the loss modulus G" of the color toner by the unit Pa of the loss modulus (which may hereinafter be simply referred to as "common logarithm of G"" or "[log G"]") on an axis of ordinate. A curve obtained by smoothly connecting the common logarithms of G" (of the color toner or the like) plotted versus temperatures (which may hereinafter be referred to as "temperature-loss modulus plot") is defined as a curve 1 <(1-1) of FIG. 1>. (1-2) shows a result obtained by differentiating the curve 1 with respect to the temperature once, and (1-3) shows a result obtained by differentiating the curve 1 with respect to the temperature twice. (1-3) is also referred to as a curve 2. Those figures are examples given for explaining a temperature Tp and a method of determining a temperature Ts, and the present invention is by no means limited by those figures.

The color toner of the present invention is characterized in that the temperature Tp at which the curve 1 shows a maximum is present, and the temperature Tp satisfies the relationship of 40° C.≦Tp≦60° C. In addition, the temperature Tp is more preferably 45° C. or higher and 55° C. or lower.

When the temperature Tp is 40° C. or higher, the surface layer (B) may be sufficiently formed, and the toner base particle (A) may be favorably turned into a capsule, so the toner can exert sufficient heat-resistant storage stability. When the temperature Tp is 60° C. or lower, the toner can exert excellent low-temperature fixability.

The loss modulus G" of the toner at the temperature Tp (G" (Tp)) is preferably $10^6$ Pa or more and $10^{10}$ Pa or less. When G" (Tp) falls within the above range, the heat-resistant storage stability of the toner becomes additionally good.

The color toner of the present invention is such that the temperature Ts at which the curve 2 obtained by differentiating the curve 1 with respect to the temperature twice shows a local minimum is present in the temperature range of Tp+10(° C.) to Tp+40(° C.). When multiple local minimums are present in the temperature range, the temperature at which the curve shows the minimum out of the local minimums is represented by Ts. In addition, Ts more preferably satisfies the relationship of Tp+15° C.≦Ts≦Tp+30° C. The fact that the second derivative of a function has a local minimum mathematically means that the original function shows a curve having a convex upwards.

A state where Ts is present at a temperature of Tp+10° C. or higher and a difference between Tp and Ts is 40° C. or less means the following.

The toner exerts excellent low-temperature fixability not only because Tp and Ts are close to each other but also because log G" reduces abruptly at a temperature slightly higher than Ts, that is, the toner has sharp melt property. A difference between Ts and Tp in excess of 40° C. makes it difficult for the toner to achieve excellent low-temperature fixability targeted by the present invention. In this case, the surface layer (B) is hard, so, even when the toner base particle (A) in the toner sufficiently melts, toner particles hardly fuse owing to the inhibition of the surface layer, and hence an image is hardly fixed. In addition, the presence of the temperature Ts in the curve 2 of the above color toner has the following meanings. One meaning is that the color toner of the present invention has such a structure that the toner base particle (A) which is mainly formed of the binder resin (a) and is soft is included in the surface layer (B) mainly formed of the resin (b) harder than the binder resin (a). Further, the other meaning is that, when the loss modulus G" of the resin of which the toner base particle (A) is formed and the loss modulus G" of the resin of which the surface layer (B) is formed are measured, the temperatures at which the loss moduli show maxima are different from each other.

In a toner having such structure, the resin (b) present on the surface of the toner maintains a glass state in a temperature region below Ts. As a result, the viscosity of the inside of the toner (toner base particle (A)) mainly formed of the binder resin (a) is hardly reflected in the viscosity of the toner, so the measured viscosity of the toner becomes relatively high. On the other hand, the resin (b) softens in a temperature region beyond the temperature Ts. As a result, the viscosity of the resin (b) is easily reflected in the viscosity of the toner, so the viscosity of the entire toner reduces abruptly. In such case, a value for G" of the toner reduces across the temperature Ts as a border, so a convex portion appears near the temperature Ts in the curve 1, and the curve 2 shows a local minimum at the temperature Ts.

Further, a state where the color toner of the present invention has the temperature Ts means that the percentage by which log G" of the toner reduces in a temperature region higher than Ts by several degrees centigrade is larger than the percentage by which log G" of the toner reduces in a temperature region lower than Ts by several degrees centigrade.

In the present invention, a ratio G"(Ts)/G"(Ts+5) is defined as an indicator for the extent to which log G" of the toner reduces in a temperature region higher than Ts by several degrees centigrade, and a value for the ratio of the color toner of the present invention is larger than 3.0. In addition, the ratio G"(Ts)/G"(Ts+5) is preferably larger than 3.5 (provided that G"(Ts) represents the loss modulus of the toner at Ts, and G"(Ts+5) represents the loss modulus of the toner at a temperature higher than Ts by 5° C.). On the other hand, the above value is more preferably smaller than 10.0, or still more preferably smaller than 8.0.

The ratio G"(Ts)/G"(Ts+5) easily affects the heat-resistant storage stability and low-temperature fixability of the toner. A method of increasing the value is, for example, any one of the following methods.

<1> The resin (b) which shows sharp melt property at a temperature higher than a temperature Tp' (Tp' will be described later) is used.

<2> The difference between the temperature Tp and the temperature Ts is increased (provided that the upper limit for the difference is 40° C.). For example, it is sufficient that the resin (b) which is relatively hard as compared to the binder resin (a) be used.

<3> The amount of the surface layers (B) is increased so that the toner base particles (A) are properly coated.

A toner having a ratio G"(Ts)/G"(Ts+5) in excess of 3.0 has excellent sharp melt property, and can exert excellent low-temperature fixability.

Further, the color toner of the present invention has a storage modulus G' at 130° C. (G'130) of preferably $1.0\times10^2$ Pa or more and $1.0\times10^4$ Pa or less. G'130 means elasticity at a fixing nip. When G'130 is less than $1.0\times10^2$ Pa, hot offset is apt to occur. On the other hand, when G'130 exceeds $1.0\times10^4$ Pa, the low-temperature fixability of the toner may be insufficient. G'130 is more preferably $3.0\times10^2$ Pa or more and $5.0\times10^3$ Pa or less. Any one of such methods as described below can be employed for controlling the storage modulus of the toner, and it is sufficient that the storage modulus at 130° C. be adjusted to fall within the above range by any one of these methods. It should be noted that a temperature of 130° C. is a temperature close to the temperature of the surface of paper when paper is passed through a general fixing unit and to the actual temperature of the toner at the time of fixation.

A method, of increasing G'130 described above is, for example, any one of the following methods:

<1> to use the binder resin (a) having a relatively large storage modulus at 130° C.; and <2> to use the resin (b) having a relatively large storage modulus at 130° C.

The method <1> is, for example, to use a binder resin having a crosslinking component as the binder resin (a).

The method <2> is, for example, to use a resin having a crosslinking component as the resin (b) in the same manner as that described above or to use a resin having a chemical bond with large bond energy such as a urethane or urea resin.

Further, when the storage modulus of the resin (b) alone at 130° C. is relatively large, the amount of the surface layers (B) each mainly formed of the resin (b) is preferably relatively small in order that the toner may exert low-temperature fixability. In this case, the binder resin (a) is preferably responsible for the offset resistance of the toner.

On the other hand, a method of reducing G'130 is to use the soft resin (a), specifically, a linear binder resin having a relatively low molecular weight. On the other hand, when the resin (b) is hard, for example, a reduction in amount of the resin (b) is applicable to the reduction of G'130. Further, for example, a resin obtained by incorporating a nonlinear (crosslinkable) polyester resin at a content of 5 mass % or more and 40 mass % or less into a linear polyester resin is used as the binder resin (a) in order that G'130 may be $1.0\times10^2$ Pa or more and $1.0\times10^4$ Pa or less.

The temperature-loss modulus plot (also referred to as "viscoelasticity") of the resin (b) alone is also important for the temperature-loss modulus plot of the above color toner to show characteristic property. That is, the resin (b) to be used in the color toner of the present invention is preferably such that a curve 3 obtained by plotting the temperature (° C.) on an axis of abscissa and the common logarithm (log G") of a value obtained by dividing the loss modulus G" (Pa) of the resin (b) by the unit (Pa) of the loss modulus on an axis of ordinate has a local maximum in the temperature range of higher than 40° C. to 100° C. or lower, and, when the temperature at which the curve 3 shows the local maximum is represented by Tp', the temperature Tp' satisfies the relationship of $Tp<Tp'\leqq Tp+30°$ C. In addition, Tp' more preferably satisfies the relationship of $Tp\leqq Tp'\leqq Tp+20°$ C.

Setting the glass transition temperature of the resin (b) within the range of 40° C. to 100° C. allows the curve 3 for the resin (b) to have a local maximum in the temperature range of higher than 40° C. to 100° C. or lower.

The loss modulus G" of the resin (b) at the temperature Tp'(G"(Tp')) is preferably $10^6$ Pa or more and $10^{10}$ Pa or less. When G"(Tp') fails within the above range, the heat-resistant storage stability of the toner becomes additionally good.

For example, a resin having composition similar to that of the binder resin (a) is used as the resin (b) in order that a difference between Tp and Tp' described above may be 30° C. or less. As described later, when a polyester resin is used as the binder resin (a) and a resin having an ester structure as the bond structure of its main chain is used as the resin (b), it is sufficient that a ratio of ester bonds be increased in the composition of the resin (b).

The toner can obtain additionally good heat-resistant storage stability and additionally good fixing performance when Tp' and Tp satisfy the above relationship.

Further, the resin (b) is preferably made additionally sharp-melt by providing the resin (b) with crystallinity or by sharpening the molecular weight distribution of the resin (b). The term "sharp melt" refers to a state where the extent to which G" or G' changes with a temperature is large. A ratio G"(Tp'+5° C.)/G"(Tp'+25° C.) of G"(Tp'+5° C.) to G"(Tp'+25° C.) is defined as an indicator for the degree of the sharp melt property of the resin (b). The larger a value for the ratio, the more sharp-melt the resin (b) (provided that G"(Tp'+5° C.) represents the loss modulus of the resin (b) at a temperature higher than the temperature Tp' by 5° C., and G"(Tp'+25° C.) represents the loss modulus of the resin (b) at a temperature higher than the temperature Tp' by 25° C.). The ratio G"(Tp'+5° C.)/G"(Tp'+25° C.) is preferably larger than 100, more preferably larger than 1,000, or still more preferably larger than 3,000. Meanwhile, from the viewpoint of the production of the toner, the ratio G"(Tp'+5° C.)/G"(Tp'+25° C.) is preferably smaller than 20,000, or more preferably smaller than 10,000.

In the present invention, the amount of the surface layers (B) is also important for the toner to obtain a specific temperature-loss modulus plot. That is, the abundance of the surface layers (B) is preferably 1.0 part by mass or more and 15.0 parts by mass or less, or more preferably 2.5 parts by mass or more and 10.0 parts by mass or less with respect to 100 parts by mass of the toner base particles (A).

When the amount of the surface layers (B) with respect to 100 parts by mass of the toner base particles (A) is 1.0 part by mass or more, a capsule type structure is favorably formed, and the exposure of each toner base particle as a core can be suppressed in an additionally favorable fashion. As a result, a reduction in heat-resistant storage stability of the toner can be suppressed in an additionally favorable fashion. In addition, the coalescence of toner particles can be prevented, whereby a toner having a sharp particle size distribution can be obtained.

On the other hand, when the amount of the surface layers (B) with respect to 100 parts by mass of the toner base particles (A) is 15.0 parts by mass or less, the ease with which the particle diameters of the particles of the toner are controlled is improved.

In the present invention, it is preferable that the binder resin (a) be mainly formed of a polyester resin, and the resin (b) be a resin having an ester bond and/or a urethane bond as the bond structures/bond structure of its main chain. The above resin (b) is more preferably a resin having an ester bond as the bond structure of its main chain. The use of a material having an ester bond in each of both the toner base particle (A) and the surface layer (B) makes them similar in chemical composition to each other, reduces the ease with which the surface layer (B) peels from the toner base particle, and allows the toner to exert additionally excellent durable stability and to correspond to a high-productivity electrophotographic apparatus.

The physical properties of a polyester resin related to the viscoelasticity of the toner such as a softening point, a glass transition temperature, and a molecular weight, distribution can be easily controlled, and the temperature Tp of the resin can be easily controlled. In addition, the resin is excellent in sharp melt property. The use of the polyester resin as a main component for the binder resin (a) can provide a color toner having the following characteristics: the toner has a reduced fixation temperature, shows high gloss at low temperatures, easily melts sufficiently to mix with any other toner at the time of fixation, and is excellent in color developing performance.

Further, the toner easily obtains desired viscoelasticity characteristics when the resin (b) is a resin having an ester bond such as a polyester resin or an ester resin having any other bond.

A general polyester resin can also be used as the "resin having an ester bond" that can be used as the resin (b); a resin containing at least a product of a reaction between a diol component and a diisocyanate component is preferable. When the resin (b) is, for example, a resin having a urethane bond, a material for the toner can be selected from an expanded variety of materials. As a result, the viscoelasticity of the toner can be relatively easily designed, whereby a color toner having high resistance against a mechanical stress and excellent in durability can be obtained.

In the present invention, the surface layer (B) is preferably formed of resin fine particles each containing the above resin (b). The surface layer formed of the resin fine particles is preferably produced as follows: the surface layer is not formed by merely externally adding the resin fine particles, but a toner particle in a slurry state the surface of which is coated with the resin fine particles is heated or swollen in a solvent so that the above resin fine particles are formed into a film shape and the toner particle is turned into a capsule type structure. With such procedure, the surface layer (B) easily obtains a uniform thickness, so the toner easily obtains desired viscoelasticity characteristics. As a result, a color toner having the following characteristics can be provided: the colorant is hardly exposed to the surface of the toner, the toner is excellent in charging stability, no wax is exposed to the surface of the toner, and the toner is excellent in flowability.

In the present invention, toner particles showing a sharp particle size distribution can be obtained by forming the surface layer (B) from resin fine particles each containing the above resin (b). Further, the formation of the surface layer (B) from the resin fine particles each containing the above resin (b) facilitates the control of the particle diameters of the particles of the toner. In the present invention, from the foregoing viewpoint, an isocyanate compound containing an ester bond is particularly preferably used in the resin (b).

The toner of the present invention, which has a capsule structure, is particularly preferably such that the capsule structure is formed so as to satisfy the following regulations.

$$40.0° \text{ C.} \leqq Tg(0.5) \leqq 60.0° \text{ C.}$$

$$2.0° \text{ C.} \leqq Tg(4.0) - Tg(0.5) \leqq 10.0° \text{ C.}$$

(In the expressions, Tg(0.5) represents the glass transition temperature of the toner obtained at a rate of temperature increase of 0.5° C./min, and Tg(4.0) represents the glass transition temperature of the toner obtained at a rate of temperature increase of 4.0° C./min.)

Tg (0.5) is a glass transition temperature reflecting the composition of the entirety of each toner particle because Tg (0.5) is the glass transition temperature of the toner measured at a low rate of temperature increase. In contrast, Tg(4.0) is a glass transition temperature reflecting only a material for the surface layer of each toner particle because Tg(4.0) is the glass transition temperature of the toner measured at a high rate of temperature increase. In addition, a state where there is a moderate temperature difference between Tg(4.0) and Tg (0.5) means that the toner base particles are favorably turned into capsules. When the temperature difference is small, the following two situations are conceivable: an unpreferable material is selected for each of the binder resin (a) and the resin (b), or the toner base particles are not favorably turned into capsules, so the resin (b) strongly affects even the measurement of Tg(4.0).

The case where Tg(4.0)−Tg(0.5) is 2.0° C. or more means that particularly good capsules are formed; the toner can obtain excellent heat-resistant storage stability, and the occurrence of a problem related to the wax or colorant at the time of the storage of the toner can be favorably suppressed. On the other hand, when Tg(4.0)−Tg(0.5) is 10.0° C. or less, the extent to which the wax exudes at a fixing nip becomes moderate at the time of the fixation of the toner, so the toner can obtain good low-temperature fixability, and the occurrence of the winding of paper or the like to which the toner is fixed around a fixing member can be suppressed. In addition, Tg(4.0)−Tg(0.5) is more preferably in the range of 2.5° C. or more to 8.0° C. or less.

It should be noted that a value for Tg(4.0)−Tg(0.5) can be adjusted by adjusting the amount of the surface layers (B) or by making the resin (a) and the resin (b) similar in composition to each other.

The following method can be suitably employed as a method of simply obtaining the toner particles to be used in the present invention; provided that a method of producing the toner of the present invention is not limited to the following.

The suitable method of producing the toner particles involves: dispersing, in an aqueous medium in which resin fine particles each containing the resin (b) are dispersed, a solution or dispersion product (oil phase) obtained by dissolving or dispersing at least the binder resin (a), the colorant, and the wax in an organic medium; and removing a solvent from the resultant dispersion liquid to dry the dispersion liquid. Here, the above resin fine particles are preferably resin fine particles each containing a product of a reaction between a diol component and a diisocyanate component, the product containing an ester bond.

In the above method, the above resin fine particles each function also as a dispersant upon suspension of a liquid product of a toner base particle composition (liquid toner composition), so the production of toner particles by the method eliminates the need for, for example, the step of agglomerating the resin fine particles to the surfaces of the toner base particles, and can provide capsule type toner particles to be used in the present invention by an additionally simple approach.

Further, the inventors of the present invention consider that, upon formation of the surface layer (B) by the above method, there must be a moderate affinity between the toner base particle (A) and each of the resin fine particles of which the surface layer (B) is formed in order that the surface layer (B) to be formed may be an intended one. That is, the consideration of the inventors is as follows: when the affinity between the toner base particle (A) and the surface layer (B) is excessively weak, the resin fine particles to serve as the surface layer (B) hardly adsorb to the surface of the toner base particle; in contrast, when the affinity is excessively strong, the fine particles are embedded in the toner base particle, so it becomes difficult to form the surface layer (B).

In view of the above consideration, in the present invention, the binder resin (a) of which the toner base particle (A) is formed is preferably a resin mainly formed of a polyester resin, and the surface layer (B) is preferably formed by using resin fine particles each containing the resin (b) containing at least a product of a reaction between a diol component and a diisocyanate component.

In general, a method of producing capsule type toner particles like the present invention is roughly classified into the step of producing the toner base particles (A) and the step of forming the surface layers (B).

A method of producing the above toner base particles (A) is by no means limited, and examples of the method include the following methods.

<1> The so-called pulverization method involving the steps of: melting and kneading the binder resin (a), the colorant, and the wax, and, optionally, a toner composition to be used as required; pulverizing the kneaded product; and sphering and classifying the pulverized products as required.

<2> The so-called emulsion agglomeration method involving: agglomerating fine particles each having a particle diameter smaller than a target toner particle diameter in an aqueous medium into particles each having a desired particle diameter with a water-soluble salt or through the control of, for example, the pH or temperature of the medium, or the rate at which the medium is stirred; and subjecting the resultant particles to melt adhesion and aging.

<3> A dissolution suspension method involving: dissolving or dispersing, in an organic solvent, the binder resin (a), the colorant, and the wax, and, if required, a toner composition to prepare a composition (oil phase); suspending the composition in an aqueous medium to prepare particles each having the target toner particle diameter; and removing the organic solvent after the suspension to provide the toner base particles.

In addition, the step of forming the surface layers (B) of the present invention is by no means limited. For example, when the toner base particles (A) are produced before the surface layers (B) are formed, any one of the following methods is applicable.

<1> The so-called wet external addition method involving: dispersing substances of which the toner base particles (A) and the surface layers (B) are formed in an aqueous medium so that the substances have fine particle shapes; and causing the fine particles of which the surf ace layers (B) are formed to agglomerate and adsorb to the surfaces of the toner base particles (A) after the dispersion.

<2> The so-called dry external addition method involving stirring substances of which the toner base particles (A) and the surface layers (B) are formed, the substances being formed into powder shapes, in a dry fashion to secure the surface layers (B) to the surfaces of the toner base particles (A) mechanically.

Alternatively, the following method what is called interfacial polymerization is another applicable approach to forming the surface layers (B) on the surfaces of the toner base particles (A): reactive monomers are mixed in the toner base particles (A) and in an aqueous medium, and a reaction is prompted at an interface between each of the toner base particles (A) and the aqueous medium so that the surface layers (B) are formed on the surfaces of the toner base particles (A). However, it takes a certain time for the method to involve the reaction, and, when the surface layers (B) each showing desired nature are to be prepared, the method may require detailed investigation on, for example, conditions for the reaction.

In the present invention, a method having the following characteristics is preferably employed: the method, is a simple method by which the above capsule type toner particles can be produced in one stage, and, from the viewpoint of an improvement in image quality, is a method by which a spherical toner having a small particle diameter and showing a sharp particle size distribution can be simply obtained. The method is preferably a method involving: preparing the toner base particles (A) by the "dissolution suspension method"; and forming the surface layers (B) by using each of resin fine particles each containing the resin (b) as a dispersant.

Hereinafter, the dissolution suspension method and the dispersant will be described in detail.

A solvent that can be used as an organic medium for dissolving the binder resin and the like in the dissolution suspension method is, for example, any one of the following solvents.

Hydrocarbon solvents such as ethyl acetate, xylene, and hexane; halogenated hydrocarbon solvents such as methylene chloride, chloroform, and dichlorethane; ester solvents such as methyl acetate, ethyl acetate, butyl acetate, and isopropyl acetate; ether solvents such as diethylether; and ketone solvents such as acetone, methylethyl ketone, diisobutyl ketone, cyclohexanone, and methyl cyclohexane.

The above aqueous medium may be water alone, or may be a combination of water and a solvent miscible with water. Examples of the miscible solvent include the following solvents.

Alcohols (methanol, isopropanol, and ethylene glycol), dimethylformaldehyde, tetrahydrofuran, cellsolves (methyl cellsolve), and lower ketones (acetone and methylethyl ketone).

The aqueous medium is used in an amount of typically 50 parts by mass or more and 2,000 parts by mass or less, or preferably 100 parts by mass or more and 1,000 parts by mass or less with respect to 100 parts by mass of a composition for the toner base particles (A). When the amount is less than 50 parts by mass, the dispersed state of the composition for the toner base particles (A) is bad, so the toner base particles (A) each having a predetermined particle diameter cannot be obtained. An amount in excess of 2,000 parts by mass is not economical.

An appropriate amount of an organic solvent to be used as an oil phase is preferably mixed into the above aqueous medium.

This is because the stability of droplets during granulation can be improved, and the aqueous phase and the oil phase can be suspended together with additional ease.

A known surfactant, polymer dispersant (water-soluble polymer), or the like as well as each of the above resin fine particles can be used as the above dispersant.

A main surfactant is, for example, an anionic surfactant, a cationic surfactant, an amphoteric surfactant, or a nonionic surfactant. Each of the surfactants can be arbitrarily selected in association with polarity upon formation of the toner particles, and examples of the surfactants include the following surfactants.

Anionic surfactants such as alkylbenzene sulfonate, α-olefin sulfonate, and phosphate; cationic surfactants including amine salt type surfactants such as alkyl amine salts, amino alcohol fatty acid derivatives, polyamine fatty acid derivatives, and imidazoline, and quaternary ammonium salt type surfactants such as alkyltrimethyl ammonium salts, dialkyldimethyl ammonium salts, alkyldimethylbenzyl ammonium salts, pyridinium salts, alkylisoquinolinium salts, benzethonium chloride, pyridinium salts, and imidazolinium salts; nonionic surfactants such as fatty acid amide derivatives and polyalcohol derivatives; and amphoteric surfactants such as alanine, dodecyldi(aminoethyl)glycine, di(octylaminoethyl) glycine, and N-alkyl-N,N-dimethyl ammonium betaine.

Examples of the polymer dispersant are as follows: acids such as acrylic acid, methacrylic acid, α-cyano acrylic acid, α-cyano methacrylic acid, itaconic acid, crotonic acid, fumaric acid, maleic acid, and maleic anhydride; (meth) acrylic monomers each having a hydroxy group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide; vinyl alcohols; ethers of vinyl alcohols such as vinylmethyl ether, vinylethyl ether, and vinylpropyl ether; esters of vinyl alcohols such as vinyl acetate, vinyl propionate, and vinyl butyrate and a compound containing a carboxy group; acrylamide, methacrylamide, diacetone acrylamide, and methylol compounds thereof; acid chlorides such as acryloyl chloride and methacryloyl chloride; homopolymers or copolymers of substances each having a nitrogen atom or a heterocyclic ring such as vinyl pyridine, vinylpyrrolidone, vinyl imidazole, and ethyleneimine; polyoxyethylene polymer dispersants such as polyoxyethylene, polyoxypropylene, polyoxyethylene alkyl amine, polyoxypropylene alkylamine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester; and celluloses such as methyl cellulose, hydroxyethyl cellulose, and hydroxypropyl cellulose.

When a dispersant is used, the dispersant, which may remain on the surface of each toner particle, is preferably removed by dissolution and washing in terms of the charging of the toner.

In addition, in the present invention, it is preferable that a surface activating effect be expressed by the dissociation of a carboxyl group residue of a polyester as a binder resin instead of, or in addition to, that of the above surfactant. To be specific, a carboxyl group of the polyester can be dissociated by the presence of amines in the oil phase or aqueous phase. Amines each having a relatively low molecular weight such as ammonia water, triethylamine, and triethanolamine are preferable amines that can be used in this case.

Alternatively, in the present invention, a solid dispersion stabilizer may be used for maintaining an additionally preferable dispersed state of the composition for the toner base particles (A).

The above dispersion stabilizer is used in the present invention by reason of the following: an organic medium in which the binder resin as a main component for each of the toner base particles (A) is dissolved has a high viscosity, so the dispersion stabilizer should be used to surround droplets formed by the fine dispersion of the organic medium by a high shear force so as to prevent the reagglomeration of, and stabilize, the droplets.

Each of an inorganic dispersion stabilizer and an organic dispersion stabilizer can be used as the dispersion stabilizer. The inorganic dispersion stabilizer is preferably as follows: the stabilizer can be removed by any one of the acids each having no affinity for the medium such as hydrochloric acid because the toner particles are granulated in a state where the stabilizer adheres onto the surface of each of the particles after the dispersion. For example, calcium carbonate, calcium chloride, sodium hydroxide, potassium hydrogen hydroxide, sodium hydroxide, potassium hydroxide, hydroxyapatite, or calcium triphosphate can be used.

A method of dispersing the toner composition, oil phase, or the like is not particularly limited, and a general-purpose apparatus such as a low-speed shearing type, high-speed shearing type, friction type, high-pressure jet type, or ultrasonic stirring apparatus can be used; a high-speed shearing type stirring apparatus is preferable in order that dispersed particles may each have a particle diameter of 2 μm or more and 20 μm or less.

The stirring apparatus having a rotating blade is not particularly limited, and any apparatus can be used as long as the apparatus is generally used as an emulsifier or a dispersing machine.

Examples of the apparatus include: continuous emulsifiers such as an ULTRATURRAX (manufactured by IKA), a POLYTRON (manufactured by KINEMATICA Inc), a TK AUTOHOMOMIXER (manufactured by Tokushu Kika Kogyo), an EBARAMIXER (manufactured by EBARA CORPORATION), a TK HOMOMIC LINE FLOW (manufactured by Tokushu Kika Kogyo), a COLLOID MILL (manufactured by Shinko Pantec Co., Ltd.), a SLASHER or TRIGONAL WET PULVERIZER (manufactured by Mitsui Miike Machinery Co., Ltd.), a CAVITRON (manufactured by EuroTec), and a FINE FLOW MILL (manufactured by Pacific Machinery & Engineering Co., Ltd.); and batch type or continuous duplex emulsifiers such as a CLEAR MIX (manufactured by MTECHNIQUE Co., Ltd.) and a FILMIX (manufactured by Tokushu Kika Kogyo).

When a high-speed shearing type dispersing machine is used, the number of revolutions of the machine, which is not particularly limited, is typically 1,000 rpm or more and 30,000 rpm or less, or preferably 3,000 rpm or more and 20,000 rpm or less.

In the case of a batch type dispersing machine, the time period for which the toner composition, oil phase, or the like is dispersed is typically 0.1 minute or more and 5 minutes or less. The temperature of the environment surrounding the toner composition, oil phase, or the like at the time of the dispersion is typically 10° C. or higher and 150° C. or lower (under pressure), or preferably 10° C. or higher and 100° C. or lower.

The following method can be adopted for removing an organic solvent from the resultant dispersion liquid (emulsion dispersion body): the temperature of the entire system is gradually increased so that the organic solvent in each droplet is completely removed by evaporation.

Alternatively, the following method can also be adopted: the emulsion dispersion body is sprayed in a dry atmosphere, a water-insoluble organic solvent in each droplet is completely removed so that toner fine particles are formed, and, together with the formation, an aqueous dispersant is removed by evaporation.

In that case, the dry atmosphere in which the emulsion dispersion body is sprayed is, for example, a gas obtained by heating the air, nitrogen, a carbon dioxide gas, or a combustion gas; in particular, various air streams heated to temperatures equal to or higher than the boiling point of a solvent having the highest boiling point out of the solvents to be used are generally used.

A dryer for drying the above emulsion dispersion body is, for example, a spray dryer, a belt dryer, or a rotary kiln. The use of any one of those dryers provides toner particles each having target quality in a short time period.

When the above emulsion dispersion body shows a wide particle size distribution, and is subjected to washing and drying treatments while the particle size distribution is maintained, the particle size distribution can be ordered by classifying the toner particles so that the particles have a desired particle size distribution.

The dispersant used is preferably removed from the resultant dispersion liquid to the extent, possible; the removal is more preferably performed simultaneously with the classification operation.

The following method can also be employed: the resultant toner particle powder after the drying is mixed with dissimilar particles such as release agent fine particles, charge controllable fine particles, flowability-imparting agent fine particles, and colorant fine particles as required, and, furthermore, a mechanical impact force is applied to the mixed powder to cause particles in the powder to adhere and fuse at their surfaces so that the elimination of the dissimilar particles from the surfaces of the resultant composite particles is prevented.

In the production method, a heating step can be further provided after the removal of the organic solvent.

Providing the heating step can: smoother, the surface of the toner; and adjust the sphericity of the toner.

The binder resin (a) to be used in the color toner of the present invention will be described in detail below. As described above, the binder resin (a) to be used in the present invention is preferably a resin mainly formed of a polyester resin. The expression "mainly formed of" as used herein refers to a state where the polyester resin accounts for 50 mass % or more of the total amount of the binder resin (a). In addition, the binder resin (a) has a glass transition temperature of preferably 40° C. or higher and 60° C. or lower.

Monomers that can be used in the production of the above polyester resin are, for example, the following components: an alcohol component and a carboxylic acid component.

The alcohol component is, for example, an aliphatic alcohol, having preferably 2 to 8 carbon atoms, or more preferably 2 to 6 carbon atoms.

Examples of the aliphatic alcohol having 2 to 8 carbon atoms include the following alcohols.

Linear diols such as ethylene glycol, 1,2-propylene glycol, 1,3-propylene glycol, 1,4-butanediol, 1,5-pentanediol, 1,6-hexanediol, neopentyl glycol, 1,4-butenediol, 1,7-heptanediol, and 1,8-octanediol.

In addition, examples of the other alcohol components are as follows:

hydrogenated bisphenol A, bisphenol derivatives represented by the following formula (1), and diols represented by the following formula (2).

Formula (1)

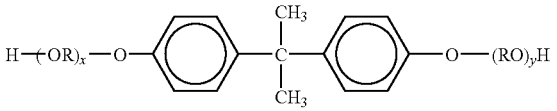

[Chem. 1]

(In the formula, R represents an ethylene group or a propylene group, x and y each represents an integer of 1 or more, and the average value of x+y is 2 to 10.)

Formula (2)

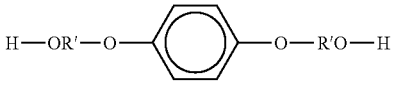

[Chem. 2]

(In the formula, R' represents —$CH_2CH_2$—, —$CH_2$—CH($CH_3$)—, or —$CH_2$—C($CH_3$)$_2$—.)

From the viewpoint of the design of the viscoelasticity of the toner, an alcohol component having anon-aromatic skeleton, that is, an alkyl diol rather than an alcohol component having an aromatic skeleton is preferably used as the alcohol component.

Further, from the viewpoint of the durability of the toner, the content of the alkyl diol is preferably 30 mol % or more, or more preferably 50 mol % or more in the alcohol component.

Meanwhile, examples of the carboxylic acid component include the following components.

Aromatic polyvalent carboxylic acids such as phthalic acid, isophthalic acid, terephthalic acid, trimellitic acid, and pyromellitic acid, aliphatic polyvalent carboxylic acids such as fumaric acid, maleic acid, adipic acid, succinic acid, dodecenylsuccinic acid, and octenylsuccinic acid each substituted by an alkyl group having 1 to 20 carbon atoms or by an alkenyl group having 2 or more and 20 or less carbon atoms, and anhydrides of the acids and esters of the acids each having an alkyl group (having 1 to 8 carbon atoms) bonded to —COO—.

The carboxylic acid component preferably contains an aromatic polyvalent carboxylic acid compound from the viewpoint of the charging performance of the toner, and the content of the aromatic polyvalent carboxylic acid compound is preferably 30 mol % or more, or more preferably 50 to 100 mol % in the carboxylic acid component.

In addition, the raw material monomers may contain a polyhydric alcohol which is trihydric or more and/or a polyvalent carboxylic acid compound which is trivalent or more.

Two or more kinds of resins having different molecular weights may be used as a mixture to serve as a binder resin when the molecular weight of the toner is adjusted, in the present invention. The viscoelasticity of the toner in the present invention is largely affected by the viscoelasticity of the binder resin (a). The following method can be preferably employed for obtaining desired viscoelasticity: a soft resin and a relatively hard resin such as linear and nonlinear binder resins are mixed to serve as the binder resin (a). The soft resin and the relatively hard resin may be mixed at an arbitrary ratio.

In the present invention, the toner particles are granulated in the aqueous medium, so the binder resin (a) preferably has a predetermined acid value. The binder resin (a) to be used in the present invention has an acid value of preferably 5.0 mgKOH/g or more and 30.0 mgKOH/g or less. When the acid value of the binder resin (a) falls within the above range, the toner particles can be easily granulated, the particle sizes and particle size distribution of the particles of the toner can be easily adjusted to desired ones, and a toner having a good capsule structure can be easily obtained.

Next, the resin (b) to be used in the color toner of the present invention will be described in detail.

The resin (b) to be used in the present invention must be a resin having the following characteristic: when the resin is turned into toner, the toner satisfies the above viscoelasticity characteristics.

For example, a resin having an ester bond or a resin having a urethane bond can be used as the resin (b); as described above, the resin having an ester bond is particularly preferable. The resin having an ester bond may be a resin containing a polyester resin alone, or may be a resin containing a resin having such a molecular structure that polyester resins are connected through a urethane bond (polyester-containing urethane). The same resin, as the polyester resin that can be used in the binder resin (a) can be used as a polyester resin that can be used in the resin (b), but the polyester resin to be used in the resin (b) must be slightly harder than the polyester resin to be used in the binder resin (a). The resin (b) is preferably a polyester-containing urethane so as to obtain desired viscoelasticity.

The resin, (b) is preferably produced by causing a diisocyanate to react with a low-molecular weight diol and a polymer diol because desired viscoelasticity characteristics can be easily imparted to the resin (b) by the production method. When the resin (b) is a polyester-containing urethane, the resin (b) is preferably a product of a reaction between a polyester having alcoholic hydroxyl groups at both of its terminals and a diisocyanate component.

Further, when the resin (b) is a polyester-containing urethane, a polymer diol is preferably used as the diol component. The polymer diol is such that the structure of a portion sandwiched between two OH groups has a polymer structure, and the polymer diol is more preferably a polyester having alcoholic hydroxyl groups at both of its terminals. Further, it is preferable that the polymer structure of the polymer diol be a polyester structure, and main components for acid, components and/or alcohol components be identical to each other with regard to the polyester skeleton of the polyester structure and the polyester skeleton of the polyester resin of which the binder resin (a) is formed. This is because an affinity between the surface layer (B) mainly formed of the resin (b) and the toner base particle (A) is improved. The improvement can result in an improvement in durability of the toner.

In the present invention, an alcohol and an isocyanate are preferably caused to react with each other in order that a urethane bond may be formed. Further, it is preferable that the alcohol be an alcohol having two hydroxyl groups in any one of its molecules (diol) and the isocyanate be an isocyanate having two isocyanate groups in any one of its molecules (diisocyanate) from the following viewpoints: a crosslinking reaction between the alcohol and the isocyanate should be controlled, and the viscoelasticity of the resin (b) should be controlled. In addition, the alcohol is more preferably a primary alcohol in order that the reactivity of the alcohol with the isocyanate may be improved.

In the case where the resin (b) is produced from a diol component and a diisocyanate component, when the number of moles of the diol component is represented by [OH] and the number of moles of the diisocyanate component is represented by [NCO], a ratio [NCO]/[OH] of [NCO] to [OH] is preferably 1.0 or less, or more preferably 0.5 or more and 0.9 or less.

When the ratio [NCO]/[OH] is 1.0 or less, a crosslinking reaction between the molecules of the isocyanate component can be suppressed, and the temperature at which G" of the resin (b) shows a peak can be suppressed to a low level. As a result, the resin (b) can be easily controlled so as to satisfy the relationship of Tp'≦Tp+30° C., and Tp' can be made 100° C. or lower. On the other hand, when the ratio [NCO]/[OH] is 0.5 or more, the resin (b) can be easily controlled so as to satisfy the relationship of Tp<Tp'. When a polymer diol is used as the diol component, a molecular weight to be used in the calculation of the number of moles is a number average molecular weight determined by a method to be described later.

The above polymer diol has a number average molecular weight of preferably 3,000 or less, or more preferably 2,000 or less. In addition, the number average molecular weight is preferably 500 or more. Further, the polymer diol preferably shows a sharp molecular weight distribution.

In addition, the polymer diol preferably accounts for 50 mass % or less of all the diols. When the content of the polymer diol is 50 mass % or less, the uniformity of the composition of the resin (b) is improved, and desired toner viscoelasticity can be easily obtained.

Examples of the polymer diol that can be used in the present invention include: a diol having a polyester structure obtained from a diol having 2 or more and 18 or less carbon atoms and a dicarboxylic acid having 2 or more and 16 or less carbon atoms (excluding the carbon atoms of the carboxyl groups); a diol having a polyether structure having a repeating unit with 2 or more and 12 or less carbon atoms; and a mixture of them. Any such diol may have a side chain.

Examples of such diols include: a polyester resin obtained from adipic acid, and 1,4-butanediol (at a molar ratio of 1:1); and a polyester resin having a number average molecular weight of about 2,000 obtained from a mixture of 1,3-propanediol, ethylene glycol, and 1,4-butanediol at a ratio of 50 mol %:40 mol %:10 mol % and an equimolar mixture of terephthalic acid and isophthalic acid.

Examples of the low-molecular-weight diol that can be; used in the present invention are as follows:

<1> alkylene glycols such as ethylene glycol, 1,2-propylene glycol, 1,3-propylene glycol, 1,4-butanediol, 1,6-hexanediol, octanediol, decanediol, dodecanediol, tetradecanediol, neopentyl glycol, and 2,2-diethyl-1,3-propanediol. The alkyl parts of the alkylene glycols may be linear or branched. In the present invention, alkylene glycols of branched structure may also be preferably used;

<2> alkylene ether glycols such, as diethylene glycol, triethylene glycol, dipropylene glycol, polyethylene glycol, polypropylene glycol, and polytetramethylene ether glycol;

<3> alicyclic diols such as 1,4-cyclohexanedimethanol and hydrogenated bisphenol A;

<4> bisphenols such as bisphenol A, bisphenol F, and bisphenol S;

<5> alkylene oxide (ethylene oxide, propylene oxide, and butylene oxide) adducts of the above alicyclic diols;

<6> alkylene oxide (ethylene oxide, propylene oxide, and butylene oxide) adducts of the above bisphenols; and <7> polylactone diols such as poly ε-caprolactone diol and polybutadiene diols.

A compound having an amino group can also be used in combination with the above components in the preparation of the resin (b). The compound having an amino group is preferably a diamine. The usage of the diamine is preferably less than 5.0 mass % in the composition of the resin (b). When the diamine is used at a ratio of less than 5.0 mass %, the increase of the temperature Tp' can be suppressed, and the ratio G"(Tp'+5° C.)/G"(Tp'+25° C.) can be favorably controlled.

Examples of the diamine that can be used in the present invention are as follows:

saturated hydrocarbon diamines such as diaminoethane, diaminopropane, diaminobutane, and diaminohexane, piperazine, 2,5-dimethyl piperazine, amino-3-aminomethyl-3,5,5-trimethyl cyclohexane (isophoronediamine, IPDA), 4,4'-diaminodicyclohexyl methane, 1,4-diaminocyclohexane, aminoethyl ethanol amine, hydrazine, and hydrazine hydrate.

It is not preferable that a compound having three or more amino groups in any one of its molecules (triamine) be used in the preparation of the resin (b).

Examples of the diisocyanate component to be used in the resin (b) in the present invention include the following diisocyanates.

An aromatic diisocyanate having 6 or more and 20 or less carbon atoms (excluding the carbon atoms in the NCO groups, the same holds true for the following), an aliphatic diisocyanate having 2 or more and 18 or less carbon atoms, an alicyclic diisocyanate having 4 or more and 15 or less carbon atoms, an aromatic hydrocarbon diisocyanate having 8 or more and 15 or less carbon atoms, and a modified product of each of these diisocyanates (modified product containing a urethane, carbodiimide, allophanate, urea, burette, urethodione, urethoimine, isocyanurate, or oxazolidone group), and a mixture of two or more kinds of them.

Specific examples of the aromatic diisocyanate are as follows:

1,3-phenylene diisocyanate, 1,4-phenylene diisocyanate, 2,4-tolylene diisocyanate, 2,6-tolylene diisocyanate (TDI), 2,4'-diphenylmethane diisocyanate, 4,4'-diphenylmethane diisocyanate (MDI), 1,5-naphthylene diisocyanate, m-isocyanatophenyl sulfonylisocyanate, and p-isocyanato phenylsulfonyl isocyanate.

Specific examples of the aliphatic diisocyanate are as follows:

aliphatic diisocyanates such as ethylene diisocyanate, tetramethylene diisocyanate, hexamethylene diisocyanate (HDI), dodecamethylene diisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, and 2-isocyanatoethyl-2,6-diisocyanato hexanoate.

Specific examples of the alicyclic diisocyanate are as follows:

isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexane-1,2-dicarboxylate, 2,5-norbornane diisocyanate, and 2,6-norbornane diisocyanate.

Specific examples of the aromatic hydrocarbon diisocyanate are as follows:

m-xylylene diisocyanate, p-xylylene diisocyanate (XDI), and α,α,α',α'-tetramethyl xylylene diisocyanate (TMXDI).

In addition, the above modified product of each of the diisocyanates is, for example, a modified product containing a urethane, carbodiimide, allophanate, urea, burette, urethodione, urethoimine, isocyanurate, or oxazolidone group. Specific examples of the modified product include modified products of isocyanates such as modified MDI (urethane-modified MDI, carbodiimide-modified MDI, or trihydrocarbyl phosphate-modified MDI) and urethane-modified TDI, and a mixture of two or more kinds of them [such as a combination of modified. MDI and urethane-modified TDI (isocyanate-containing prepolymer)].

Of those, an aromatic diisocyanate having 6 or more and 15 or less carbon atoms, an aliphatic diisocyanate having 4 or more and 12 or less carbon atoms, and an alicyclic diisocyanate having 4 or more and 15 or less carbon atoms are preferable. The use of an aliphatic diisocyanate easily makes the resin (b) relatively soft. On the other hand, the use of an aromatic diisocyanate easily makes the resin (b) relatively hard. Of such diisocyanates, TDI, MDI, HDI, hydrogenated MDI, and IPDI are preferable. Further, in order that a toner excellent in color developing performance may be obtained, a non-aromatic diisocyanate is preferably used from the following viewpoint: a toner containing the diisocyanate hardly becomes yellowish owing to light.

Of such preferable diisocyanates, isophorone diisocyanate is preferably used, in the present invention in terms of the ease with which the resin (b) is produced and the ease with which the resin (b) having desired viscoelasticity is obtained.

The resin (b) has a number average molecular weight of preferably 10,000 or less, or more preferably 2,000 or more and 8,000 or less.

The resin fine particles to be used for forming the surface layer (B) will be described below. As described earlier, the resin fine particles are each mainly formed of the resin (b). The resin fine particles are each preferably mainly formed of a polyester resin or a product of a reaction between the diol component and the diisocyanate component, or are each more preferably mainly formed of a polyester-containing urethane.

In the present invention, the particle diameters of the resin fine particles of which the surface layer (B) is formed may affect the temperature-loss modulus plot of the toner.

The resin fine particles to be used in the present invention have a number average particle diameter of preferably 10 nm or more and 150 nm or less. When the particle diameter of each of the resin fine particles is large, the formation of the surface layer (B) of a film shape requires an additionally large amount of the resin fine particles. On the other hand, when the particle diameter of each of the resin fine particles is small, a relatively small amount of the resin fine particles can result in the formation of the surface layer (B) of a sufficient film shape. When the particle diameter of each of the resin fine particles is relatively large, the following procedure is preferably adopted: the toner particles are heated or swollen in a solvent so that each surface layer is formed into a film and the toner particles are turned into capsules.

When the above number average particle diameter is 10 nm or more, it becomes easy to form a capsule structure even when the toner particles are produced in an aqueous medium.

When the number average particle diameter of the resin fine particles is 150 nm or less, the thickening of the surface layer can be suppressed. In addition, when the toner particles of the present invention are obtained in an aqueous medium, the dispersing performance of the particles in the aqueous medium can be favorably maintained, and the coalescence of the particles or the generation of particles having different shapes can be suppressed.

When the above surf ace layer (B) is produced from resin fine particles each containing the above produce of a reaction between the diol component and the diisocyanate component in an aqueous medium, it is also preferable that a side chain of the product of a reaction between, the diol component and the diisocyanate component have a carboxyl group structure or a sulfonic group structure.

Here, in order that the resin fine particles may each be used as a dispersant, the dispersing performance (self-emulsifying performance) of the resin fine particles themselves in the aqueous medium is also an important parameter in the production of the toner particles. The inventors of the present invention have made extensive studies on the dispersing performance of the resin fine particles each containing the product of a reaction between the diol component and the diisocyanate component. As a result, the inventors have discovered that the presence of a structure capable of adopting a salt structure such as a carboxyl group or a sulfonic group at a side chain of the product of a reaction between the diol component and the diisocyanate component drastically improves the dispersing performance of the product of a react ion between the diol component and the diisocyanate component in the aqueous medium, and improves the granulating performance of the toner.

When the above surface layer (B) is formed of resin fine particles each containing the product of a reaction between the diol component and the diisocyanate component, the resin fine particles are preferably dispersed in an aqueous medium so that the particles are each used as a dispersant. In this case, the dispersing performance of the resin fine particles in the aqueous medium is also important.

In this sense, the product of a reaction between the diol component and the diisocyanate component is preferably of such, a structure that a side chain of the product has a carboxyl group. The carboxyl group can be easily introduced by providing the carboxyl group for a side chain of monomers of which the product of a reaction between the diol component and the diisocyanate component is formed. A diol compound having a carboxyl group at any one of its side chains can be suitably used as a general-purpose monomer out of the monomers.

Examples of the above-mentioned diol compound having a carboxyl group at any one of its side chains include the following compounds.

Dihydroxylcarboxylic acids such as dimethylolacetic acid, dimethylolpropionic acid, dimethylolbutanoic acid, dimethylolbutanoic acid, and dimethylolpentanoic acid, and salts of the acids.

A monomer having a sulfonic group at any one of its side chains as well as the above-mentioned, monomer having a carboxyl group at any one of its side chains is effective in achieving the above, object. A diol compound having a sulfonic group at any one of its side chains is, for example, sulfoisophthalic acid or N,N-bis(2-hydroxyethyl)-2-aminoethanesulfonic acid, or a salt of each of the acids.

In the present invention, a carboxyl group-containing diol and a sulfonic group-containing diol are more preferably used in combination. Although the reason for the foregoing is unclear, investigation conducted by the inventors of the present invention has shown that the combined use of them provided a good result in maintaining the dispersing performance of the resin fine particles in water, the insolubility of the resin fine particles in ethyl acetate, and, furthermore, the moderate affinity of the toner base particle (A) for polyester.

It should be noted that the carboxyl group-containing diol is preferably used as a main component because the carboxyl group-containing diol has higher general-purpose property than that of the sulfonic group-containing diol.

The content of the carboxyl group-containing diol and/or the sulfonic group-containing diol described above in the monomers of which the product of a reaction between the diol component and the diisocyanate component is formed is preferably 10 mol % or more and 50 mol % or less, or more preferably, 20 mol % or more and 30 mol % or less. When the content of the diols/diol is smaller than 10 mol %, the dispersing performance of the resin fine, particles in the aqueous medium deteriorates, and the granulating performance of the toner is remarkably impaired in some cases. In addition, when the content is larger than 50 mol %, the product of a reaction between the diol component and the diisocyanate component dissolves in the aqueous medium so as to be unable to function as a dispersant sufficiently in some cases.

In addition, the presence of a carboxyl group as a polar group at a side chain of the product of a reaction between the diol component and the diisocyanate component has a lowering effect on the solubility of the resin fine particles in ethyl acetate. When the content of the carboxyl group-containing diol is smaller than that described above, the resin fine particles may dissolve in ethyl acetate depending on the molecular weight or composition of the product of a reaction between the diol component and the diisocyanate component.

A method of producing the above resin fine particles is not particularly limited, and is, for example, (1) an emulsion polymerization method or (2) a method involving: dissolving the resin in a solvent, or melting the resin, to liquefy the resin; and suspending the liquid in the aqueous medium to granulate the liquid.

In this case, a known surfactant or dispersant can be used as described above, or the resin of which each of the resin fine particles is formed can be provided with self-emulsifying performance.

Examples of the solvent that can be used when the resin fine particles are prepared by dissolving the resin in the solvent include, but not particularly limited to, the following solvents.

Hydrocarbon solvents such as ethyl acetate, xylene, and hexane, halogenated hydrocarbon solvents such as methylene chloride, chloroform, and dichlorethane, ester solvents such as methyl acetate, ethyl acetate, butyl acetate, and isopropyl acetate, ether solvents such as diethyl ether, ketone solvents such as acetone, methyl ethyl ketone, diisobutyl ketone, cyclohexanone, and methylcyclohexane, and alcohol solvents such as methanol, ethanol, and butanol.

In addition, in one preferred embodiment of the present invention, resin fine particles each containing the product of a reaction between the diol component and the diisocyanate component are each used as a dispersant. The following method can be preferably employed as a method for the production of the product: a prepolymer having an isocyanate group is produced, the prepolymer is rapidly dispersed in water, and, subsequently, the above compound having an active hydrogen group capable of reacting with the isocyanate group is added so that the chains of the molecules of the prepolymer are extended, by linking or are crosslinked.

That is, in the present invention, the following method can be suitably used for producing the product of a reaction between the diol component and the diisocyanate component having desired physical properties: a prepolymer having an isocyanate group, and, as required, any other needed component are dissolved or dispersed in a solvent having high solubility in water such as acetone or an alcohol out of the above solvents, water is then charged into the resultant to disperse the prepolymer system having an isocyanate group rapidly, and the compound having an active hydrogen group is loaded into the dispersion liquid.

The color toner of the present invention contains a wax in each of its toner base particles (A) for improving its releasing performance from a fixing member and its fixing performance.

As the wax, known waxes may be used, and, for example, the following waxes are exemplified:

polyolefin waxes such as polyethylene wax and polypropylene wax; long chain hydrocarbons such as paraffin wax and sasol wax; and carbonyl group-containing waxes.

Of those, preferred are carbonyl group-containing waxes.

Examples of the carbonyl group-containing wax include: polyalkanoic acid esters such as carnauba wax, montan wax, trimethylolpropane tribehenate, pentaerythritol tetrabehenate, pentaerythritol diacetate dibehenate, glycerin tribehenate, and 1,18-octadecane diol-bis-stearate; polyalkanol esters such as tristearyl trimellitate and distearyl maleate; polyalkanoic amide such as ethylene diamine dibehenyl amide; polyalkyl amide such as tristearyl amide trimellitate; and alkyl ketone such as distearyl ketone.

The above wax has a melting point of preferably 40° C. or higher and lower than 160° C., or more preferably 50° C. or higher and lower than 120° C. When the melting point is lower than 40° C., the wax is apt to be exposed to the surface of the toner, so a reduction, in heat-resistant storage stability of the toner may occur. In addition, when the melting point is 160° C. or higher, the wax does not melt properly at the time of the fixation of the toner, so the wax may not exert its effect.

In the present invention, the content of the wax with respect to 100 parts by mass of the toner base particles (A) is preferably 2.0 parts by mass or more and less than 20.0 parts by mass, or more preferably 2.5 parts by mass or more and less than 15.0 parts by mass.

When the content of the wax is 2.0 parts by mass or more, the releasing performance of the toner can be sufficiently maintained. In addition, when the content of the wax is less than 20.0 parts by mass, the exposure of the wax to the surface of the toner can be favorably suppressed, and a reduction in flowability of the toner can be suppressed. As a result, a high-definition image can be obtained, and the toner can obtain additionally good heat-resistant storage stability.

A method of introducing the wax when a dissolution suspension method is employed in the present invention is, for example, any one of the following methods:

<1> a method involving melting or dissolving the wax in an organic solvent, precipitating the wax in the solvent after the melting or the dissolution, and mechanically dispersing the resultant as required to prepare a dispersion liquid of the wax in the organic solvent in advance;

<2> a method involving melting or dissolving the wax in an oil phase containing at least an organic solvent, the binder resin (a), and the colorant to granulate the wax, and cooling the resultant to introduce the wax into each of the toner base particles (A); and <3> a method involving the use of mechanically pulverized products of the powder of the wax.

In one preferred embodiment of the color toner of the present invention, a wax dispersant is used for dispersing the wax in each of the toner base particles (A) in an additionally uniform fashion. The wax dispersant is not particularly limited, and any known wax dispersant can be used.

Further, the oil phase is preferably subjected to ultrasonic dispersion immediately before the addition of the oil phase to an aqueous phase for the purpose of loosening the agglomerated wax in the oil phase. At that time, the temperature of the oil phase is preferably kept at a temperature equal to or lower than the melting point of the wax and equal to or lower than the boiling point of the solvent.

In addition, the agglomerated colorant in the oil phase can also be loosened simultaneously with the above loosening. As a result, a toner in which the wax and the pigment are dispersed excellently can be prepared.

A known apparatus can be used as an apparatus that applies an ultrasonic wave to the oil phase.

The colorant to be used in the color toner of the present invention is, for example, any such colorant as described below.

A pigment or a dye can be used in order that the colorant may be suitable for a yellow color.

As the pigment, for example, the following pigments are exemplified: C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191: and C.I. Vat Yellow 1, 3, and 20. As the dye, for example, the following dyes are exemplified: C.I. Solvent Yellow 19, 44, 77, 79, 81, 82, 93, 98, 103, 104, 112, and 162. Those may be used alone, or two or more kinds of them may be used in combination.

As the suitable colorant for magenta, a pigment or a dye may be used.

Examples of the pigment may include the following: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, and 254; C.I. Pigment Violet 19; and C.I. Vat Red 1, 2, 10, 13, 15, 23, 29, and 35. Examples of the dye may include the following: Oil soluble dyes such as C.I. Solvent Red 1, 3, 8, 23, 24, 25, 27, 30, 49, 52, 53, 63, 81, 82, 33, 84, 100, 109, 111, 121 and 122; C.I. Disperse Red 9; C.I. Solvent Violet 8, 13, 14, 21, and 27; and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40; and C.I. Basic Violet 1, 3, 7, 10, 14, 15, 21, 25, 26, 27, and 28. Those may be used alone, or two or more kinds of them may be used in combination.

As the suitable colorant for cyan, a pigment or a dye may be used.

As the pigment, for example, the following pigments are exemplified: C.I. Pigment Blue 1, 7, 15, 15:1, 15:2, 15:3, 15:4, 16, 17, 60, 62, and 66; C.I. Vat Blue 6; and C.I. Acid Blue 45. As the dye, for example, the following dyes are exemplified: C.I. Solvent Blue 25, 36, 60, 70, 93, and 95. Those may be used alone, or two or more kinds of them may be used in combination.

As a black pigment, for example, carbon black such as furnace black, channel black, acetylene black, thermal black, or lamp black is used. In addition, a magnetic powder such as magnetite or ferrite is used.

The color toner of the present invention can contain a charge control agent. A known charge control agent can be used in the present invention, and examples of the charge control agent include the following agents.

Triphenylmethane dyes, metal-containing azo complex dyes, molybdic acid chelate pigments, rhodamine dyes, alkoxy amines, quaternary ammonium salts (including a fluorine-modified quaternary ammonium salt), alkylamides, metal salicylates, and metal salts of salicylic acid derivatives.

To be additionally specific, examples of the charge control agent include: a BONTRON S-34 as a metal-containing azo dye, a BONTRON E-82 as an oxynaphthoic acid metal complex, a BONTRON E-84 as a salicylic acid metal complex, and a BONTRON E-89 as a phenol condensate (each of which is manufactured by Orient Chemical Industries Ltd.); a Copy Charge COPY CHARGE PSY VP2038 as a quaternary ammonium salt, a COPY CHARGE NEG VP2036 as a quaternary ammonium salt, and a COPY CHARGE NX VP434 (each of which is manufactured by Hoechst AG); and an LRA-901 and an LR-147 as a boron complex (each of which is manufactured by Japan Carlit Co., Ltd.).

Inorganic fine particles each serving as an external additive for aiding the flowability, developing performance, and charging performance of the color toner of the present invention are preferably added to the toner.

The inorganic fine particles each have a primary particle diameter of preferably 5 nm or more and less than 2 μm, or particularly preferably 5 nm or more and less than 500 nm. In addition, the inorganic fine particles have a specific surface area according to a BET method of preferably 20 $m^2/g$ or more and less than 500 $m^2/g$.

The inorganic fine particles are used at a ratio of preferably 0.01 to 5 parts by mass, or more preferably 0.01 part by mass or more and less than 2.0 parts by mass with respect to 100 parts by mass of the toner particles. The inorganic fine particles may be of one kind, or may be a combination of multiple kinds.

Specific examples of the inorganic fine particles are as follows: silica, alumina, titanium oxide, barium titanate, magnesium titanate, calcium titanate, strontium titanate, zinc oxide, tin oxide, silica sand, clay, mica, wollastonite, diatomaceous earth, chromium oxide, eerie oxide, blood red, antimony trioxide, magnesium oxide, zirconium oxide, barium sulfate, barium carbonate, calcium carbonate, silicon carbide, and silicon nitride.

In addition to those, preferable examples thereof include polymer fine particles, for example, polycondensation particles such as polystyrene, methacrylate copolymers, acrylate copolymers, silicone, benzoguanamine, and nylon obtained by soap-free emulsion polymerization, suspension polymerization, and dispersion polymerization, and polymer particles formed of thermosetting resins.

The deterioration of the flowability characteristic and charging characteristic of any such external additive under high humidity can be suppressed by treating the surface of the external additive to improve the hydrophilicity of the external additive.

A preferable surface treatment agent is, for example, any one of the following agents.

A silane coupling agent, a silylating agent, a silane coupling agent having an alkyl fluoride group, an organic titanate coupling agent, an aluminum coupling agent, a silicone oil, and a modified silicone oil.

A cleaning performance improver for removing a developer after transfer remaining on a photosensitive member or primary transfer medium is, for example, any one of the following substances: aliphatic acid metal salts such as zinc stearate, calcium stearate, and stearic acid, and polymer fine particles produced by soap-free emulsion polymerization such as polymethyl methacrylate fine particles and polystyrene fine particles.

It is preferable that the above polymer fine particles show a relatively narrow particle size distribution, and have a volume average particle diameter of 0.01 μm or more and 1 μm or less.

When the color toner of the present invention is used in a two-component developer, it is sufficient that the color toner be mixed with a magnetic carrier before use. A content ratio between the carrier and the toner in the developer is preferably as follows: the toner is used, in an amount of 1 part by mass or more and 10 parts by mass or less with respect to 100 parts by mass of the magnetic carrier.

A conventionally known magnetic carrier such as a ferrite powder, magnetite powder, or magnetic resin carrier having an average particle diameter of 20 μm or more and less than 70 μm can be used as the magnetic carrier.

The color toner of the present invention has a weight average particle diameter (D4) of preferably 3.0 μm or more and less than 10.0 μm.

When D4 is 3.0 μm or more, the charge-up of the toner can be suppressed, and a reduction in density of an image formed with the toner as compared to that of an image formed with the toner at an initial stage can be favorably suppressed even after the toner has been used for a long time period. In addition, when D4 is less than 10.0 μm, even in the case where a line image is output, the scattering of the toner or a dot-like defect can be suppressed, and the line image can obtain additionally good fine-line reproducibility.

In the present invention, the toner has a sphericity SF-1 in the range of preferably 100 or more to less than 140, or more preferably 100 or more to less than 130. That is, when a value for SF-1 is 100, the toner shows a shape close to a true sphere, so a toner shape having a sphericity close to 100 is more preferable.

When the value for SF-1 is less than 140, the toner can obtain a good transfer characteristic, and hence an image having high quality can be obtained.

When the toner particles are produced by a dissolution suspension method, a heating step can be further provided after the removal of the organic solvent. Providing the heating step can: smoothen the surface of the toner; and adjust the sphericity of the toner.

Hereinafter, measurement methods and evaluation methods according to the present invention will be described.

<Method of measuring dynamic viscoelasticity of toner>

(1) Method of measuring loss modulus (G") and how to determine Tp, Ts, and G"(Ts) described above Measurement is performed with a viscoelasticity measuring apparatus (Rheometer) ARES (manufactured by Rheometrics Scientific). The outline of the measurement, which is described in the operation manuals 902-30004 (version in August, 1997) and 902-00153 (version in July, 1993) of the ARES published by Rheometrics Scientific, is as described below.

Measuring jig: a serrated parallel plate having a diameter of 7.9 mm is used.

Measurement sample: a cylindrical sample having a diameter of about 8 mm and a height of about 2 mm is produced from the toner with a pressure molder (15 kN is maintained at normal temperature for 1 minute). A 100 kN Press NT-100H manufactured by NPa SYSTEM CO., LTD. is used as the pressure molder.

The temperature of the senate parallel plate is adjusted to 80° C. The cylindrical sample is melted by heating. Sawteeth are engaged in the molten sample, and a load is applied to the sample in the direction perpendicular to the sample so that an axial force does not exceed 30 (grams weight). Thus, the sample is caused to adhere to the serrate parallel plate. In this case, a steel belt may be used in order that the diameter of the sample may be equal to the diameter of the parallel plate. The serrate parallel plate and the cylindrical sample are slowly cooled to the temperature at which the measurement is initiated, that is, 30.00° C. over 1 hour.

Measuring frequency: 6.28 radians/sec

Setting of measurement strain: measurement is performed according to an automatic measurement mode while an initial value is set to 0.1%.

Correction for elongation of sample: the elongation is adjusted according to the automatic measurement mode.

Measurement temperature: The temperature is increased from 30° C. to 200° C. at a rate of 2° C/min.

Measurement interval: Viscoelasticity data is measured every 30 seconds, that is, every 1° C.

Data is transferred to an RSI ORCHESTRATOR (software for control, data acquisition, and analysis) (manufactured by Rheometrics Scientific) that operates on a WINDOWS 2000 manufactured by Microsoft Corporation through an interface.

The curve 1 shown in (1-1) of FIG. 1 is obtained by the above measurement.

A value for the second derivative of the resultant curve 1 at a temperature T can be determined as described below.

First, a gradient Δ1 between the pieces of measurement data at two adjacent measurement temperatures (a temperature (T−1) and the temperature (T)) is determined.

$$\Delta 1 = \{\log G''(T) - \log G''(T-1)\}/\{T-(T-1)\}$$
$$= \log G''(T) - \log G''(T-1)$$

Δ1 is defined as data on a first derivative at a temperature (T−0.5) midway between the two points.

In addition, a gradient Δ2 between the pieces of measurement data at next two adjacent measurement temperatures (the temperature (T) and a temperature (T+1)) at a temperature (T+0.5) midway between the temperatures is similarly determined as described below.

$$\Delta 2 = \{\log G''(T+1) - \log G''(T)\}/\{(T+1)-T\}$$
$$= \log G''(T+1) - \log G''(T)$$

Δ2 is defined as data on a first derivative at the temperature (T+0.5).

Next, a gradient (Δ') between the two points, that is, the data Δ1 on the first derivative at the temperature (T−0.5) and the data Δ2 on the first derivative at the temperature (T+0.5) is calculated.

$$\Delta' = (\Delta 2 - \Delta 1)/\{(T+0.5)-(T-0.5)\}$$
$$= \Delta 2 - \Delta 1$$
$$= \log[\{G''(T+1)\times G''(T-1)\}/\{G''(T)\}^2]$$

Δ' is defined as data on a second derivative at the temperature T.

A value for the second derivative of logG" with respect to the temperature is calculated as described above, whereby the curve 2 is obtained. The temperature Ts at which the curve 2 shows the minimum out of the local minimums of the second derivative of logG" with respect to the temperature in the range of the temperature Tp (temperature at which the curve 1 shows a maximum) or higher to lower than 100° C. is determined. Thus, G"(Ts) is determined. It should be noted that, in the measurement, in consideration of the shape of the resultant curve 2, a peak largely deviating from the basic shape of the curve is judged to be a noise, and is not regarded as a peak.

Method of Measuring Acid Value of Resin

An acid value is the number of milligrams of potassium hydroxide needed for the neutralization of an acid in 1 g of a sample. The acid value of a binder resin is measured in conformance with JIS K 0070-1966. To be specific, the measurement is performed in accordance with the following procedure.

(1) Preparation of Reagent 1.0 g of phenolphthalein is dissolved in 90 ml of ethyl alcohol (95 vol %). Ion-exchanged water is added to the solution so that the mixture has a volume of 100 ml. Thus, a "phenolphthalein solution" is obtained.

7 g of reagent grade potassium hydroxide are dissolved in 5 ml of water. Ethyl alcohol (95 vol %) is added to the solution so that the mixture has a volume of 1 l. The mixture is left to stand in an alkali-resisting container for 3 days while being out of contact with a carbon dioxide gas. After that, the mixture is filtrated, whereby a "potassium hydroxide solution" is obtained. The resultant potassium hydroxide solution is stored in the alkali-resisting container. Standardization is performed in conformance with JIS K 0070-1996.

(2) Operation (A.) Run Proper 2.0 g of a pulverized sample of the binder resin are precisely weighed in a 200-ml Erlenmeyer flask, and 100 ml of a mixed solution of toluene and ethanol (at a ratio of 2:1) are added to dissolve the sample over 5 hours. Subsequently, several drops of the phenolphthalein solution as an indicator are added to the solution, and the solution is titrated with the potassium hydroxide solution. It should be noted that the amount of the solution in which the faint red color of the indicator continues for about 30 seconds is defined as the end point of the titration.

(B) Blank Run

Titration is performed by the same operation as that described above, except that no sample is used (that is, only the mixed solution of toluene and ethanol (at a ratio of 2:1) is used).

(3) The acid value of the sample is calculated by substituting the obtained results into the following equation:

$$A=[(B-C)\times f\times 5.61]/S$$

where A represents the acid value (mgKOH/g), B represents the addition amount (ml) of the potassium hydroxide solution in the blank run, C represents the addition amount (ml) of the potassium hydroxide solution in the run proper, f represents the factor of the potassium hydroxide solution, and S represents the mass (g) of the sample.

<Method of Measuring Molecular Weight Distribution>

The molecular weight distribution of the THF soluble matter of a resin is measured by gel permeation chromatography (GPC) as described below.

First, the resin is dissolved in tetrahydrofuran (THF) at room temperature over 24 hours. Then, the resultant solution is filtrated through a solvent-resistant membrane filter "MAISHORI DISK" (manufactured by TOSOH CORPORATION) having a pore diameter of 0.2 μm, whereby a sample solution is obtained. It should be noted that the concentration of a component soluble in THF in the sample solution is adjusted to about 0.8 mass %. Measurement is performed by using the sample solution under the following conditions.

Apparatus: HLC8120 GPC (detector: RI) (manufactured by TOSOH CORPORATION)

Column: SHODEX KF-801, 802, 803, 804, 805, 806, 807 (manufactured by SHOWA DENKO K.K.), seven columns connected Elution solution: tetrahydrofuran (THF)

Flow rate: 1.0 ml/minute

Oven temperature: 40.0° C.

Sample injection amount: 0.10 ml

Upon calculation of the molecular weight of the sample, a molecular weight calibration curve prepared with a standard polystyrene resin (such as a product available under the trade name "TSK Standard Polystyrene F-850, F-450, F-288, F-128, F-80, F-40, F-20, F-10, F-4, F-2, F-1, A-5000, A-2500, A-1000, or A-500" from TOSOH CORPORATION) is used.

<Method of Measuring Tg>

Figure 2:
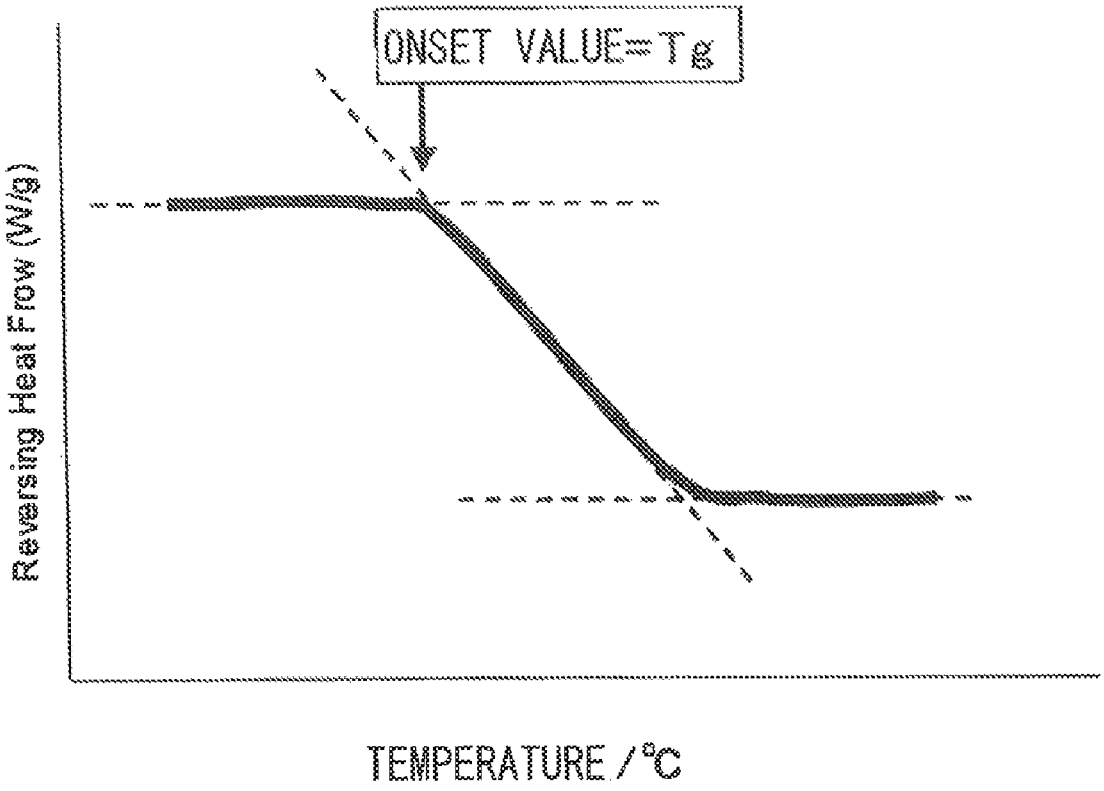
FIG. 2 shows a method of calculating a Tg with a DSC curve.

A Tg in the present invention was measured with a DSC Q1000 (manufactured by TA Instruments) under the following conditions, and an onset value shown in FIG. 2 was defined as the Tg.

<<Measurement Conditions>>

Modulation Mode

Temperature increase rate: 1) binder resin 0.1° C./minute 2) toner 0.5° C./minute or 4.0° C./minute Modulation temperature amplitude: ±1.0° C./minute Measurement starting temperature: 25° C.

Measurement terminating temperature: 130° C.

A temperature increase was performed only once, and a DSC curve was obtained by representing a "Reversing Heat Flow" on an axis of ordinate. Then, the onset value shown in FIG. 2 was defined as the Tg of the present invention.

<Method of Measuring Particle Diameters of Resin Fine Particles>

A Microtrac particle size distribution measuring apparatus UPA (model 9230) (manufactured by NIKKISO CO., LTD.) based on a dynamic light scattering method (Doppler scattered light analysis) was used. Measurement was performed in a set range of 0.001 μm or more to less than 10 μm, and a number average particle diameter (nm) was defined as the particle diameter of each of the resin fine particles of the present invention. The measurement was performed in accordance with details about the apparatus described in an instruction manual (Document No. T15-490A00) issued by NIKKISO CO., LTD. Conditions for the measurement are as described below.

Particle Material Latex (refractive index of 1.59)

Fluid: water (refractive index of 1.33)

Single Level: the concentration was adjusted to 0.10 to 1.00

Measurement period: 180 seconds

<Methods of Measuring Weight Average Particle Diameter (D4) and Number Average Particle Diameter (D1) of Toner>

The particle diameters of the particles of toner were measured with a precision particle size distribution measuring apparatus based on a pore electrical resistance method provided with a 100-μm aperture tube "COULTER COUNTER MULTISIZER 3" (registered trademark, manufactured by Beckman Coulter, Inc) and dedicated software included with the apparatus "BECKMAN COULTER MULTISIZER 3 VERSION 3.51" (manufactured by Beckman Coulter, Inc) for setting measurement conditions and analyzing measurement data while the number of effective measurement channels was set to 25,000. The weight average particle diameter (D4) and number average particle diameter (D1) of the toner were calculated by analyzing the measurement data.

An electrolyte solution prepared by dissolving reagent grade sodium chloride in ion-exchanged water to have a concentration of about 1 mass %, for example, an "ISOTON II" (manufactured by Beckman Coulter, Inc) can be used in the measurement.

It should be noted that the dedicated software was set as described below prior to the measurement and the analysis.

In the "change of standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc) is set as a Kd value. A threshold and a noise level are automatically set by pressing a "threshold/noise level measurement" button. In addition, a current is set to 1,600 μA, a gain is set to 2, and an electrolyte solution is set to an ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte solution are charged into a 250-ml round-bottom beaker made of glass dedicated for the MULTISIZER 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the analysis software.

(2) About 30 ml of the electrolyte solution are charged into a 100-ml flat-bottom beaker made of glass. About 0.3 ml of a diluted solution prepared by diluting a "CONTAMINON N" (a 10-mass% aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three mass fold is added as a dispersant to the electrolyte solution.

(3) An ultrasonic dispersing unit "ULTRASONIC DISPERSION SYSTEM TETRA 150" (manufactured by Nikkaki Bios Co., Ltd.) in which two oscillators each having an oscillatory frequency of 50 kHz are built so as to be out of phase by 180° and which has an electrical output of 120 W is prepared. A predetermined amount of ion-exchanged water is charged into the water tank of the ultrasonic dispersing unit. About 2 ml of the CONTAMINON N are charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker may resonate with an ultrasonic wave from the ultrasonic dispersing unit to the fullest extent possible.

(5) About 10 mg of toner are gradually added to and dispersed in the electrolyte solution in the beaker in the section (4) in a state where the electrolyte solution is irradiated with the ultrasonic wave. Then, the ultrasonic dispersion treatment is continued for an additional 60 seconds. It should be noted that the temperature of water in the water tank is appropriately adjusted so as to be 10° C. or higher and 40° C. or lower upon ultrasonic dispersion.

(6) The electrolyte solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight average particle diameter (D4) and number average particle diameter (D1) of the toner are calculated. It should be noted that an "average diameter" on the "analysis/volume statistics (arithmetic average)" screen of the dedicated software when the dedicated software is set to show a graph in a vol % unit is the weight average particle diameter (D4), and an "average diameter" on the "analysis/number statistics (arithmetic average)" screen of the dedicated software when the dedicated software is set to show a graph in a number % unit is the number average particle diameter (D1).

EXAMPLES

Hereinafter, the present invention will be described more specifically by way of examples. However, the present invention is by no means limited by these examples.

<Production of Binder Resin (a)-1>

The following materials were loaded into a reaction vessel provided with a cooling pipe, a nitrogen introducing pipe, and a stirring machine.

| | |
|---|---|
| Propylene glycol | 858 parts by mass (11.3 parts by mol) |
| Dimethyl terephthalate | 873 parts by mass (4.5 parts by mol) |
| Adipic acid | 219 parts by mass (1.5 parts by mol) |
| Tetrabutoxy titanate (condensation catalyst) | 3 parts by mass |

The mixture was subjected to a reaction at 180° C. in a stream of nitrogen for 8 hours while produced methanol was removed by distillation. Subsequently, the temperature of the mixture was gradually increased to 230° C., and, during the temperature increase, the mixture was subjected to a reaction in a stream of nitrogen for 4 hours while produced propylene glycol and produced water were removed by distillation. Further, the mixture was subjected to a reaction under a reduced pressure of 20 mmHg, and the resultant was taken out when its softening point reached 90° C. The taken resin was cooled to room temperature, and was then pulverized into particles, whereby a binder resin (a)-1 as a linear polyester resin was obtained. Table 1 shows the physical properties of the resultant resin.

<Production of Binder Resin (a)-2>

The following materials were loaded into a reaction vessel provided with a cooling pipe, a nitrogen introducing pipe, and a stirring machine.

| | |
|---|---|
| 1,3-propanediol | 860 parts by mass (11.3 parts by mol) |
| Dimethyl terephthalate | 776 parts by mass (4.0 parts by mol) |
| Adipic acid | 292 parts by mass (2.0 parts by mol) |
| Tetrabutoxy titanate (condensation catalyst) | 3 parts by mass |

The mixture was subjected to a reaction at 180° C. in a stream of nitrogen for 8 hours while produced methanol was removed, by distillation. Subsequently, the temperature of the mixture was gradually increased to 230° C., and, during the temperature increase, the mixture was subjected to a reaction in a stream of nitrogen for 4 hours while produced propylene glycol and produced water were removed by distillation. Further, the mixture was subjected to a reaction under a reduced pressure of 20 mmHg, and the resultant was taken out when its softening point reached 90° C. The taken resin was cooled to room temperature, and was then pulverized into particles, whereby a binder resin (a)-2 as a linear polyester resin was obtained. Table 1 shows the physical properties of the resultant resin.

<Production of Binder Resin (a)-3>

The following materials were loaded into a reaction vessel provided with a cooling pipe, a nitrogen introducing pipe, and a stirring machine.

| | |
|---|---|
| 1,4-pentanediol | 1,198 parts by mass (11.5 parts by mol) |
| Dimethyl terephthalate | 951 parts by mass (4.9 parts by mol) |
| Adipic acid | 234 parts by mass (1.8 parts by mol) |
| Tetrabutoxy titanate (condensation catalyst) | 3 parts by mass |

The mixture was subjected to a reaction at 180° C. in a stream of nitrogen for 8 hours while produced methanol was removed by distillation. Subsequently, the temperature of the mixture was gradually increased to 230° C., and, during the temperature increase, the mixture was subjected to a reaction in a stream of nitrogen for 4 hours while produced propylene glycol and produced water were removed by distillation. Further, the mixture was subjected to a reaction under a reduced pressure of 20 mmHg, and the resultant was taken out when its softening point reached 90° C. The taken resin was cooled to room temperature, and was then pulverized into particles, whereby a binder resin (a)-3 as a linear polyester resin was obtained. Table 1 shows the physical properties of the resultant resin.

<Production of Binder Resin (a)-4>

The following materials were loaded into a reaction vessel provided with a cooling pipe, a nitrogen introducing pipe, and a stirring machine.

| | |
|---|---|
| Propylene glycol | 799 parts by mass (10.5 parts by mol) |
| Dimethyl terephthalate | 815 parts by mass (4.2 parts by mol) |
| Adipic acid | 263 parts by mass (1.6 parts by mol) |
| Tetrabutoxy titanate (condensation catalyst) | 3 parts by mass |

The mixture was subjected to a reaction at 180° C. in a stream of nitrogen for 8 hours while produced methanol was removed by distillation. Subsequently, the temperature of the mixture was gradually increased to 230° C., and, during the temperature increase, the mixture was subjected to a reaction in a stream of nitrogen for 4 hours while produced propylene glycol and produced water were removed by distillation. Further, the mixture was subjected to a reaction under a reduced pressure of 20 mm Kg for 1 hour. Subsequently, the resultant was cooled to 180° C., 173 parts by mass (0.9 part; by mol) of trimellitic anhydride were added to the resultant, and the mixture was subjected to a reaction under normal pressure for 2 hours while the reaction vessel, was hermetically sealed. After that, the mixture was subjected to a reaction at 220° C. under normal pressure, and the resultant was taken out when its softening point reached 180° C. The taken resin was cooled to room temperature, and was then pulverized into particles, whereby a binder resin (a)-4 as a nonlinear polyester resin was obtained. Table 1 shows the physical properties of the resultant resin.

<Production of Binder Resin (a)-5>

The following materials were loaded into a reaction vessel provided with a cooling pipe, a nitrogen introducing pipe, and a stirring machine.

| | |
|---|---|
| 1,4-butanediol | 928 parts by mass (10.3 parts by mol) |
| Dimethyl terephthalate | 776 parts by mass (4.0 parts by mol) |

-continued

| | |
|---|---|
| Adipic acid | 292 parts by mass (2.0 parts by mol) |
| Tetrabutoxy titanate (condensation catalyst) | 3 parts by mass |

The mixture was subjected to a reaction at 180° C. in a stream of nitrogen for 8 hours while produced methanol was removed by distillation. Subsequently, the temperature of the mixture was gradually increased to 230° C., and, during the temperature increase, the mixture was subjected to a reaction in a stream of nitrogen for 4 hours while produced propylene glycol and produced water were removed by distillation. Further, the mixture was subjected to a reaction under a reduced pressure of 20 mmHg for 1 hour. Subsequently, the resultant was cooled to 180° C., 115 parts by mass (0.6 part by mol) of trimellitic anhydride were added to the resultant, and the mixture was subjected to a reaction under normal pressure for 2 hours while the reaction vessel was hermetically sealed. After that, the mixture was subjected to a reaction at 220° C. under normal pressure, and the resultant was taken out when its softening point reached 180° C. The taken resin was cooled to room temperature, and was then pulverized into particles, whereby a binder resin (a)-5 as a nonlinear polyester resin was obtained. Table 1 shows the physical properties of the resultant resin.

<Production of Binder Resin (a)-6>

The following materials were loaded into a reaction vessel provided with a cooling pipe, a nitrogen introducing pipe, and a stirring machine.

| | |
|---|---|
| Propylene glycol | 761 parts by mass (10.0 parts by mol) |
| Dimethyl terephthalate | 815 parts by mass (4.2 parts by mol) |
| Adipic acid | 584 parts by mass (4.0 parts by mol) |
| Tetrabutoxy titanate (condensation catalyst) | 3 parts by mass |

The mixture was subjected to a reaction at 180° C. in a stream of nitrogen for 8 hours while produced methanol was removed by distillation. Subsequently, the temperature of the mixture was gradually increased to 230° C., and, during the temperature increase, the mixture was subjected to a reaction in a stream of nitrogen for 4 hours while produced propylene glycol and produced water were removed by distillation. Further, the mixture was subjected to a reaction under a reduced pressure of 20 mmHg for 1 hour. Subsequently, the resultant was cooled to 180° C., 211 parts by mass (1.1 part by mol) of trimellitic anhydride were added to the resultant, and the mixture was subjected to a reaction under normal pressure for 2 hours while the reaction vessel was hermetically sealed. After that, the mixture was subjected to a reaction at 220° C. under normal pressure, and the resultant was taken, out when its softening point reached 180° C. The taken resin was cooled to room, temperature, and was then pulverized into particles, whereby a binder resin (a)-6 as a nonlinear polyester resin was obtained. Table 1 shows the physical properties of the resultant resin.

<Production of Binder Resin (a)-7>

The following materials were loaded into a reaction vessel provided with a cooling pipe, a nitrogen introducing pipe, and a stirring machine.

| | |
|---|---|
| 1,5-hexanediol | 1,241 parts by mass (10.5 parts by mol) |
| Dimethyl terephthalate | 873 parts by mass (4.5 parts by mol) |
| Adipic acid | 219 parts by mass (1.5 parts by mol) |
| Tetrabutoxy titanate (condensation catalyst) | 3 parts by mass |

The mixture was subjected to a reaction at 180° C. in a stream of nitrogen for 8 hours while produced methanol was removed by distillation. Subsequently, the temperature of the mixture was gradually increased to 230° C., and, during the temperature increase, the mixture was subjected to a reaction in a stream of nitrogen for 4 hours while produced propylene glycol and produced water were removed by distillation. Further, the mixture was subjected to a reaction under a reduced pressure of 20 mmHg, and the resultant was taken out when its softening point reached 80° C. The taken resin was cooled to room temperature, and was then pulverized into particles, whereby a binder resin (a)-7 as a linear polyester resin was obtained. Table 1 shows the physical properties of the resultant resin.

<Production of Binder Resin (a)-8>

The following materials were loaded, into a reaction vessel provided with a cooling pipe, a nitrogen introducing pipe, and a stirring machine.

| | |
|---|---|
| Styrene | 320 parts by mass |
| n-butyl acrylate | 146 parts by mass |
| Methacrylic acid | 11 parts by mass |

Further, 8 parts by mass of 2,2'-azobis(2,4-dimethylvaleronitrile) as a polymerization initiator were loaded into the mixture, and the whole was polymerized at 60° C. for 8 hours. The temperature of the resultant was increased to 150° C., and the resultant was taken out of the reaction vessel. The resultant was cooled to room temperature, and was then pulverized into particles, whereby a binder resin (a)-8 as a linear vinyl resin was obtained. Table 1 shows the physical properties of the resultant resin.

TABLE 1

| | Composition | Tg (° C.) | G" at 130° C. (Pa) | Acid value (mgKOH/g) |
|---|---|---|---|---|
| Binder resin (a)-1 | Linear polyester resin | 44 | $1.1 \times 10^2$ | 14 |
| Binder resin (a)-2 | | 41 | $1.5 \times 10^2$ | 16 |
| Binder resin (a)-3 | | 38 | $2.1 \times 10^2$ | 16 |
| Binder resin (a)-4 | Nonlinear polyester resin | 65 | $5.7 \times 10^3$ | 6 |
| Binder resin (a)-5 | | 59 | $4.1 \times 10^3$ | 5 |
| Binder resin (a)-6 | | 67 | $9.1 \times 10^4$ | 9 |
| Binder resin (a)-7 | Linear polyester resin | 32 | $6.7 \times 10^1$ | 17 |
| Binder resin (a)-8 | Vinyl resin | 62 | $8.9 \times 10^3$ | 13 |

Next, a method of preparing a dispersion liquid of resin fine particles will be described.

<Preparation of Dispersion Liquid of Resin Fine Particles 1>

The following materials were loaded into an autoclave provided with a temperature gauge and a stirring machine, and the mixture was subjected to an ester exchange reaction while being heated at 200° C. for 120 minutes.

| | |
|---|---|
| Dimethyl terephthalate | 116 parts by mass |
| Dimethyl isophthalate | 66 parts by mass |
| Trimellitic anhydride | 3 parts by mass |
| Propylene glycol | 120 parts by mass |
| 1,4-butanediol | 60 parts by mass |
| Tetrabutoxy titanate | 0.1 part by mass |

Subsequently, the temperature of the reaction system was increased to 220° C., and the resultant was continuously subjected to the reaction for 60 minutes while the pressure of the system was set to 8 mmHg. Thus, a polyester resin 1 (acid value: 13 mgKOH/g, hydroxyl value: 56 mgKOH/g, number average molecular weight: 1,100) was obtained.

| | |
|---|---|
| The above polyester resin 1 (polymer diol) | 240 parts by mass |
| Dimethylolpropanoic acid | 28 parts by mass (0.21 part by mol) |
| 3-(2,3-dihydroxypropoxy)-1-propanesulfonic acid | 84 parts by mass (0.33 part by mol) |

The above materials were dissolved in 500 parts by mass of acetone. Subsequently, 220 parts by mass (0.99 part by mol) of isophorone diisocyanate were added to the solution, and the mixture was subjected to a reaction at 60° C. for 4 hours. 21 parts by mass (0.21 part by mol) of triethylamine for neutralizing the carboxyl group of dimethylolpropanoic acid were loaded into the above reaction product, and the mixture was stirred. The above acetone solution was dropped to 1,500 parts by mass of ion-exchanged water while ion-exchanged water was stirred, whereby the acetone solution was emulsified in ion-exchanged water. Subsequently, 320 parts by mass of water, 9 parts by mass (0.15 part by mol) of ethylenediamine, and 6 parts by mass (0.08 part by mol) of n-butylamine were added to the emulsion, and the mixture was subjected to a reaction at 50° C. for 4 hours. The resultant was diluted with ion-exchanged water so as to have a solid content ratio of 13%, whereby a dispersion liquid of resin fine particles 1 was obtained.

The resin fine particles 1 in the dispersion liquid had a number average particle diameter of 43 nm. Further, the dispersion liquid of the resin fine particles 1 was dried at normal temperature, and the viscoelasticity of each of the resin fine particles 1 was measured. As a result, the following values were obtained: Tp'=70° C. and G"(Tp'+5° C.)/G"(Tp'+25° C.)=3,900. Table 2 shows the physical properties of the resultant resin fine particles.

<Preparation of Dispersion Liquid of Resin Fine Particles 2>

The following materials were loaded into an autoclave provided with a temperature gauge and a stirring machine, and the mixture was subjected to an ester exchange reaction while being heated at 190° C. for 120 minutes.

Dimethyl terephthalate 116 parts by mass

Dimethyl isophthalate 66 parts by mass 5-sodium sulfoneisophthalate methyl ester 3 parts by mass

| | |
|---|---|
| Trimellitic anhydride | 5 parts by mass |
| Propylene glycol | 150 parts by mass |
| Tetrabutoxy titanate | 0.1 part by mass |

Subsequently, the temperature of the reaction system was increased to 220° C., and the resultant was continuously subjected to the reaction for 60 minutes while the pressure of the system was set to 8 mmHg. Thus, a polyester resin 2 (acid value: 11 mgKOH/g, hydroxyl value: 53 mgKOH/g, number average molecular weight: 1,000) was obtained.

40 parts by mass of the above polyester resin 2, 15 parts by mass of methyl ethyl ketone, and 10 parts by mass of tetrahydrofuran were mixed at 80° C. so that the resin was dissolved. After that, 60 parts by mass of water at 80° C. were added to the resin solution while the solution was stirred, whereby an aqueous dispersion of the polyester resin was obtained. Further, the dispersion was diluted with ion-exchanged, water so as to have a solid content ratio of 13%, whereby a dispersion liquid of resin fine particles 2 was obtained.

The resin fine particles 2 in the dispersion liquid had a number average particle diameter of 57 nm. The dispersion liquid of the resin fine particles 2 was dried at normal temperature, and the viscoelasticity of each of the resin fine particles 2 was measured. As a result, the following values were obtained: Tp'=72° C. and G"(Tp'+5° C.)/G"(Tp'+25° C.)=5,700. Table 2 shows the physical properties of the resultant resin fine particles.

<Preparation of Dispersion Liquid of Resin Fine Particles 3>

Ion-exchanged water 100 parts by mass

A 50% aqueous solution of sodiumdodecyl diphenyl ether disulfonate (Eleminol MON-7: manufactured by Sanyo Chemical Industries Ltd.) 20 parts by mass The above materials were loaded into a reaction vessel that could be hermetically sealed, and the mixture was stirred with a stirring blade at 500 rpm. During the stirring, a mixed liquid of the following monomers was dropped to the mixture over 1 hour.

| | |
|---|---|
| Styrene | 90 parts by mass (0.87 part by mol) |
| Methacrylic acid | 50 parts by mass (0.57 part by mol) |
| Butyl acrylate | 10 parts by mass (0.08 part by mol) |

Further, 400 parts by mass of ion-exchanged water and 100 g of a 2% aqueous solution of potassium persulfate were loaded into the mixture, and the temperature in the vessel was increased to 90° C. and held at the temperature for 30 minutes. Subsequently, a dropping apparatus connected to the above reaction vessel was filled with 540 g of a 2% aqueous solution of potassium persulfate, and, while the mixture in the reaction vessel was stirred with the stirring blade at 100 rpm, the 2% aqueous solution of potassium persulfate was dropped to the mixture over 5 hours so that emulsion polymerization was performed. After the completion of the dropping, the resultant was continuously stirred for an additional 30 minutes. After that, the resultant was cooled to room temperature and diluted, with ion-exchanged water so as to have a solid content ratio of 13%, whereby a dispersion liquid of resin fine particles 3 was obtained.

The resin fine particles 3 in the dispersion liquid, had a number average particle diameter of 55 nm. Further, the dispersion liquid of the resin fine particles 3 was dried at normal temperature, and the viscoelasticity of each of the resin fine particles 3 was measured. As a result, the following values were obtained: Tp'=76° C. and G"(Tp'+5° C.)/G"(Tp'+25° C.)=4,300. Table 2 shows the physical properties of the resultant resin fine particles.

<Preparation of Dispersion Liquid of Resin Fine Particles 4>

A polyester resin having a number average molecular weight of about 2,000 (acid value: 2 mgKOH/g, hydroxyl value: 19 mgKOH/g) obtained from an alcohol mixture prepared by mixing 1,3-propanediol, ethylene glycol, and 1,4-butanediol at a ratio of 50 mol %, 40 mol %, and 10 mol %, respectively, and an acid mixture prepared by mixing terephthalic acid and isophthalic acid at a

| | |
|---|---|
| ratio of 50 mol % and 50 mol %, respectively | 240 parts by mass |
| 1,4-hexanediol | 35 parts by mass (0.30 part by mol) |
| Dimethylolpropanoic acid | 30 parts by mass (0.22 part by mol) |
| 3-(2,3-dihydroxypropoxy)-1-propanesulfonic acid | 82 parts by mass (0.32 part by mol) |

The above materials were dissolved in 500 parts by mass of acetone. Subsequently, 236 parts by mass (1.35 parts by mol) of toluene diisocyanate were added to the solution, and the mixture was subjected to a reaction at 60° C. for 4 hours. 23 parts by mass (0.22 part by mol) of triethylamine for neutralizing the carboxyl group of dimethylolpropanoic acid were loaded into the above reaction product, and the mixture was stirred. The above acetone solution was dropped to 1,500 parts by mass of ion-exchanged, water while ion-exchanged water was stirred, whereby the acetone solution was emulsified in ion-exchanged water. Subsequently, 320 parts by mass of water, 11 parts by mass (0.18 part by mol) of ethylenediamine, and 6 parts by mass (0.08 part by mol) of n-butylamine were added to the emulsion, and the mixture was subjected to a reaction at 50° C. for 4 hours. The resultant was diluted with ion-exchanged water so as to have a solid content ratio of 13%, whereby a dispersion liquid of resin fine particles 4 was obtained.

The resin fine particles 4 in the dispersion liquid had a number average particle diameter of 56 nm. Further, the dispersion liquid of the resin fine particles 4 was dried at normal temperature, and the viscoelasticity of each of the resin fine particles 4 was measured. As a result, the following values were obtained: Tp'=89° C. and G"(Tp'+5° C.)/G"(Tp'+25° C.)=1,400. Table 2 shows the physical properties of the resultant resin fine particles.

<Preparation of Dispersion Liquid of Resin Fine Particles 5>

A polyester resin having a number average molecular weight of about 2,000 (acid value: 2 mgKOH/g, hydroxyl value: 19 mgKOH/g) obtained from an alcohol mixture, prepared by mixing 1,3-propanediol, ethylene glycol, and 1,4-butanediol at a ratio of 50 mol %, 40 mol %, and 1.0 mol %, respectively, and an acid mixture prepared, by mixing terephthalic acid and isophthalic acid at a

| | |
|---|---|
| ratio of 50 mol % and 50 mol %, respectively | 95 parts by mass |
| 1,4-butanediol | 20 parts by mass (0.22 part by mol) |
| Dimethylolpropanoic acid | 85 parts by mass (0.63 part by mol) |
| 3-(2,3-dihydroxypropoxy)-1-propanesulfonic acid | 5 parts by mass (0.02 part by mol) |

The above materials were dissolved in 500 parts by mass of acetone. Subsequently, 250 parts by mass (1.12 parts by mol) of isophorone diisocyanate were added to the solution, and the mixture was subjected to a reaction at 60° C. for 4 hours. 64 parts by mass (0.63 part by mol) of triethylamine for neutralizing the carboxyl group of dimethylolpropanoic acid were loaded into the above reaction product, and the mixture was stirred. The above acetone solution was dropped to 1,500 parts by mass of ion-exchanged water while ion-exchanged water was stirred, whereby the acetone solution was emulsified in ion-exchanged water. Subsequently, 320 parts by mass of water, 9 parts by mass (0.15 part by mol) of ethylenediamine, and 6 parts by mass (0.15 part by mol) of n-butyl amine were added to the emulsion, and the mixture was subjected to a reaction at 50° C. for 4 hours. The resultant was diluted with ion-exchanged water so as to have a solid content ratio of 13%, whereby a dispersion liquid of resin fine particles 5 was obtained.

The resin fine particles 5 in the dispersion liquid had a number average particle diameter of 59 nm. Further, the dispersion liquid of the resin fine particles 5 was dried at normal temperature, and the viscoelasticity of each of the resin fine particles 5 was measured. As a result, the following values were obtained: Tp'=136° C. and G"(Tp'+5° C.)/G"(Tp'+25° C.)=800. Table 2 shows the physical properties of the resultant resin fine particles.

<Preparation of Dispersion Liquid of Resin Fine Particles 6>

| | |
|---|---|
| The above polyester resin 1 | 250 parts by mass |
| Neopentyl glycol | 36 parts by mass (0.35 part by mol) |
| Dimethylolpropanoic acid | 119 parts by mass (0.89 part by mol) |
| 3-(2,3-dihydroxypropoxy)-1-propanesulfonic acid | 16 parts by mass (0.06 part by mol) |

The above materials were dissolved in 500 parts by mass of acetone. Subsequently, 290 parts by mass (1.30 parts by mol) of isophorone diisocyanate were added to the solution, and the mixture was subjected to a reaction at 60° C. for 4 hours. 90 parts by mass (0.89 part by mol) of triethylamine for neutralizing the carboxyl group of dimethylolpropanoic acid were loaded into the above reaction product, and the mixture was stirred. The above acetone solution was dropped to 2,510 parts by mass of ion-exchanged water while ion-exchanged water was stirred, whereby the acetone solution was emulsified in ion-exchanged water. The resultant was diluted with ion-exchanged water so as to have a solid content ratio of 13%, whereby a dispersion liquid of resin fine particles 6 was obtained.

The resin fine particles 6 in the dispersion liquid had a number average particle diameter of 45 nm. Further, the dispersion liquid of the resin fine particles 6 was dried at normal temperature, and the viscoelasticity of each of the resin fine particles 6 was measured. As a result, the following values were obtained: Tp'=65° C. and G"(Tp'+5° C.)/G"(Tp'+25° C.)=7,400. Table 2 shows the physical properties of the resultant resin fine particles.

<Preparation of Dispersion Liquid of Resin Fine Particles 7>

| | |
|---|---|
| 1,9-nonanediol | 180 parts by mass (1.13 part by mol) |
| Dimethylolpropanoic acid | 120 parts by mass (0.90 part by mol) |
| 3-(2,3-dihydroxypropoxy)-1-propanesulfonic acid | 19 parts by mass (0.70 part by mol) |

The above materials were dissolved in 500 parts by mass of acetone. Subsequently, 350 parts by mass (1.57 parts by mol) of isophorone diisocyanate were added to the solution, and the mixture was subjected to a reaction at 60° C. for 4 hours. 91 parts by mass (0.90 part by mol) of triethylamine for neutralizing the carboxyl group of dimethylolpropanoic acid were loaded into the above reaction product, and the mixture was stirred. The above acetone solution was dropped to 1,500 parts by mass of ion-exchanged water while ion-exchanged water was stirred, whereby the acetone solution was emulsified in ion-exchanged water. The resultant was diluted with ion-exchanged water so as to have a solid, content ratio of 13%, whereby a dispersion liquid of resin fine particles 7 was obtained.

The resin fine particles 7 in the dispersion liquid had a number average particle diameter of 44 nm. Further, the dispersion liquid of the resin fine particles 7 was dried at normal temperature, and the viscoelasticity of each of the resin fine particles 7 was measured. As a result, the following values were obtained: Tp'=79° C. and G"(Tp'+5° C.)/G"(Tp'+25° C.)=9,800. Table 2 shows the physical properties of the resultant resin fine particles.

TABLE 2

| | Composition | Number average particle diameter (nm) | Tp'(° C.) | G"(Tp' + 5° C.)/ G"(Tp' + 25° C.) |
|---|---|---|---|---|
| Resin fine particles 1 | Urethane-containing fine particles | 43 | 70 | 3,900 |
| Resin fine particles 2 | Fine particles each composed only of PES | 57 | 72 | 5,700 |
| Resin fine particles 3 | Vinyl fine particles | 55 | 76 | 4,300 |
| Resin fine particles 4 | Urethane-containing fine particles | 56 | 89 | 1,400 |
| Resin fine particles 5 | | 59 | 136 | 800 |
| Resin fine particles 6 | | 45 | 65 | 7,400 |
| Resin fine particles 7 | | 44 | 79 | 9,800 |

<Preparation of wax dispersion liquid 1>50 parts by mass of Purified Carnauba Wax No. 1 (manufactured by Nippon Wax Co., Ltd. and having a melting point of 72° C.), 30 parts by mass of a wax dispersant (CERAMER 1608 manufactured by Toyo Petrolite Co., Ltd.), and 420 parts by mass of ethyl acetate were loaded into a reaction vessel provided with a temperature gauge and a stirring blade, and the mixture was heated to 78° C. for sufficient dissolution. The solution was cooled to 30° C. over 1 hour, and the wax was crystallized in a fine particle shape. After that, the crystallized wax was subjected to wet pulverization with a beads mill, whereby wax dispersion liquid 1 was obtained.

<Preparation of Colorant Dispersion Liquid. 1>

50 parts by mass of a C.I. Pigment Blue 15:3, 3 parts by mass of an AJISPER PB-822 (manufactured by Ajinomoto Co., Inc.) as a pigment dispersant, 300 parts by mass of ethyl acetate, and 50 parts by mass of glass beads each having a diameter of 1 mm were loaded into a heat-resistant glass bottle, and the mixture was shaken for 10 hours while the temperature of the environment surrounding the mixture was kept at normal temperature. After that, the glass beads were separated with a nylon mesh, whereby a colorant dispersion liquid 1 was obtained.

<Preparation of Liquid Toner Composition 1>

| | |
|---|---|
| The binder resin (a)-1 | 80 parts by mass |
| The binder resin (a)-4 | 20 parts by mass |
| The wax dispersion liquid 1 | 62 parts by mass |
| The colorant dispersion liquid 1 | 37 parts by mass |
| Ethyl acetate | 89 parts by mass |
| Triethylamine | 0.6 part by mass |

The above materials were loaded into a beaker, and the mixture was stirred with a DISPER (manufactured by Tokushu Kika Kogyo)at 2,000 rpm for 3 minutes for sufficient dissolution, whereby a liquid toner composition 1 was prepared.

<Preparation of Liquid Toner Compositions 2 to 7>

Liquid toner compositions 2 to 7 were each prepared in the same manner as in the preparation of the liquid toner composition 1 except that the kind and compounding ratio of a binder resin were changed as shown in Table 3.

Example 1

Production of Toner Particles 1

Prior to the preparation of an aqueous phase, an ultrasonic wave was applied from an ice water-filled ultrasonic dispersing unit (UT-305HS manufactured by Sharp Corporation) to a beaker containing the liquid toner composition 1 at an output of 60% for 5 minutes in order that the wax and the pigment in the liquid toner composition might be loosened.

(Emulsifying and Desolvating Steps)

| | |
|---|---|
| Ion-exchanged water | 157 parts by mass |
| The dispersion liquid of the resin fine particles 1 (4 parts by mass of the resin fine particles were loaded with respect to 100 parts by mass of the toner base particles (A).) | 34 parts by mass |
| A 50% aqueous solution of sodium dodecyl diphenyl ether disulfonate (ELEMINOL MON-7 manufactured by Sanyo Chemical Industries Ltd.) | 24 parts by mass |
| Ethyl acetate | 18 parts by mass |

The above materials were loaded into a beaker different from that containing the liquid toner composition, and the mixture was stirred with a TK HOMOMIXER (manufactured by Tokushu Kika Kogyo) at 2,000 rpm for 1 minute, whereby the aqueous phase was prepared. 160 parts by mass of the liquid toner composition 1 were charged into the aqueous phase, and the mixture was continuously stirred with the TK HOMOMIXER for 1 minute while the number of revolutions of the TK HOMOMIXER was increased to 8,000 rpm. Thus, the liquid toner composition 1 was suspended.

A stifling blade was set in the beaker, and the suspension was stirred with the blade at 100 rpm for 20 minutes. The resultant was transferred to an egg plant flask, and was subjected to desolvation at normal temperature under normal pressure over 10hours while the flask was rotated with a rotary evaporator. Thus, a water dispersion liquid of toner particles was obtained.

(Washing and Drying Steps)

The above water dispersion liquid of the toner particles was filtrated, and the filtrate was charged into 500 parts by mass of ion-exchanged water so that slurry was prepared. After that, while the system was stirred, hydrochloric acid was added to the system until the pH of the system reached 4. Then, the mixture was stirred for 5 minutes. The above slurry was filtrated again, 200 parts by mass of ion-exchanged water were added to the filtrate, and the mixture was stirred for 5 minutes; the operation was repeated three times. As a result, triethylamine remaining in the slurry was removed, whereby a filtrated cake of the toner particles was obtained. The above filtrated cake was dried with a vacuum dryer at normal temperature for 3 days and sieved with a mesh having an aperture of 75 μm, whereby toner particles 1 were obtained.

[Preparation and Evaluation of Toner 1]

Next, 40 parts by mass of the above toner particles 1, 0.40 part by mass of hydrophobic silica having a number average primary particle diameter of 20 nm (subjected to a hydrophobic treatment with 20 parts by mass of hexamethyldisilazane per 100 parts by mass of untreated silica fine particles), and 0.60 part by mass of monodisperse silica having a number average particle diameter of 120 nm (silica fine particles produced by a sol-gel method) were mixed and stirred with a MILLSER IFM-600DG (manufactured by Iwatani Corporation) (one cycle was such that the mixture was stirred for 10 seconds and the stirring was suspended for 1 minute, and the cycle was repeated four times), whereby Toner 1 was obtained. Table 4 shows the physical properties of Toner 1.

Hereinafter, the evaluation of Toner 1 for performance as a color toner will be described. A developer formed of Toner 1 (8 parts by mass) and 92 parts by mass of a silicone-coated ferrite carrier having a 50% volume diameter (D50) of 35 μm was prepared. The developer was evaluated for its performance as a color toner with a full-color copying machine CLC5000 (manufactured by Canon Inc.) reconstructed so as to be capable of changing electrophotographic process conditions. Table 4 shows the results of the evaluation. The developer had a fixation starting temperature of 100° C.; the result means that the developer exerted excellent low-temperature fixability. In evaluation for a peel temperature considered to be another indicator for low-temperature fixability, the developer showed a peel temperature of 110° C.; the result means that the developer exerted excellent adhesiveness with paper.

Evaluation items and evaluation criteria are as described below.

<Method of Evaluating Toner for Heat-Resistant Storage Stability>

A method for evaluation for heat-resistant storage stability in the present invention will be described below. 3 g of toner were loaded into a 100-ml poly cup, and were left to stand in a thermostat at 50° C. (±0.5° C. or less) for 3 days. After that, the toner was evaluated for its heat-resistant storage stability by observing the toner with the eyes and by touching the toner with a side of a finger.

(Evaluation Criteria)

A: The toner shows no change, and shows extremely excellent heat-resistant storage stability.

B: The toner shows a slight reduction in flowability, but shows excellent heat-resistant storage stability.

C: An agglomerate of the toner is generated, but the toner shows heat-resistant storage stability causing no problems in practical use.

D: An agglomerate of the toner can be picked, up, and cannot easily collapse. The toner is poor in heat-resistant storage stability.

<Method for Evaluation for Fixation Starting Temperature>

A fixation test was performed with the fixing unit of a full-color copying machine CLC5000 (manufactured by Canon Inc.) reconstructed so that a fixation temperature and a rate at which paper was passed could be manually set. The fixation temperature was determined by measuring the temperature of the surface of a fixing roller with a non-contact temperature gauge Temperature HITESTER 3445(manufactured by HIOKI E.E. CORPORATION). The rate at which paper was passed was calculated from the diameter of the fixing roller and the rotational speed of the roller indicated with a digital tachometer HT-5100 (manufactured by ONO SOKKI CO., LTD.).

An image for evaluation for fixation starting temperature was a solid unfixed image having a tip margin of 5 mm, a width of 200 mm, and a length of 40 mm produced by adjusting the development contrast of the CLC5000 in a monochromatic mode under a normal-temperature, normal-humidity environment (23° C./60%) so that a toner laid-on level on A4 paper (TKCLA4, 81.4 g/m$^2$, manufactured by Canon Inc.) was 0.6 mg/cm$^2$.

Under a normal-temperature, normal-humidity environment (23° C./60%), the rate at which paper was passed was set to 280 mm/sec, and the above unfixed image was passed through the fixing unit so as to be fixed at a fixation temperature increased from 90° C. to 180° C. in an increment of 5° C. A portion at a distance of 5 cm from the rear end of the fixed image was rubbed with soft, thin paper (such as a trade name "DASPER" manufactured by OZU CORPORATION) for five reciprocations while a load of 4.9 kPa was applied to the image. The image densities of the image before and after the rubbing were measured, and the percentage ΔD (%)by which the image density after the rubbing reduced as compared to the image density before the rubbing was calculated on the basis of the following equation. It should be noted that the image densities were each measured with a color reflection densitometer X-RITE 404A (manufactured by X-Rite).

The temperature at which ΔD (%) described above was less than 1% was defined as a fixation starting temperature.

$$\Delta D\ (\%) = (\text{image density before rubbing} - \text{image density after rubbing}) \times 100 / \text{image density before rubbing}$$

(Evaluation criteria)

A: The fixation starting temperature is in the range of 90° C. to 100° C.

B: The fixation starting temperature is in the range of 105° C. to 120° C.

C: The fixation starting temperature is in the range of 125° C. to 140° C.

D: The fixation starting temperature is 145° C. or higher.

<Method for Evaluation for Peel Temperature>

Figure 3:
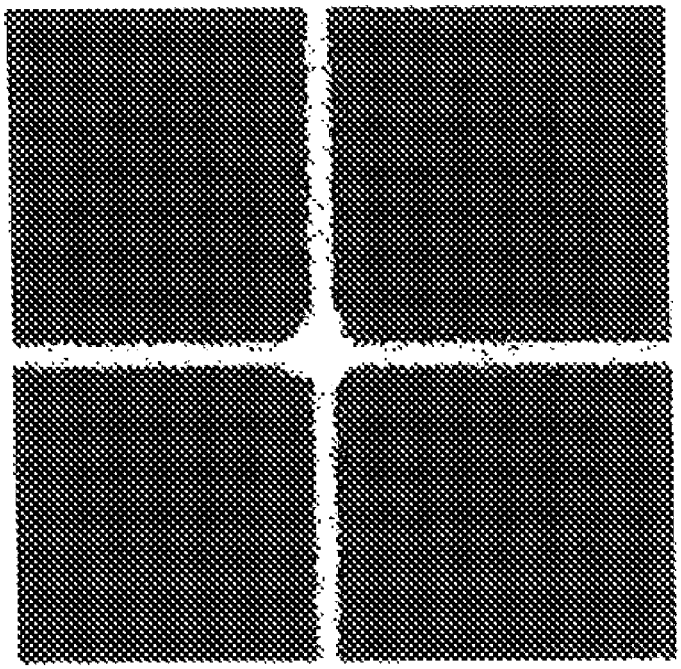
FIG. 3 shows an image obtained by peeling a fixed image and binarizing the peeled image.

Toner was evaluated for its low-temperature fixability from a viewpoint different from the fixation starting temperature. Evaluation for ease with which the toner adhered to paper at a low temperature was performed by the following method. A solid unfixed image was produced in the same manner as in the method for evaluation for fixation starting temperature, and a fixed image was obtained in the same manner as in the method. Subsequently, the fixed image was folded in the shape of a cross, and was rubbed with soft, thin paper (such as a trade name "DASPER" manufactured by OZU CORPORATION) for five reciprocations while a load of 4.9 kPa was applied to the image. Such sample as shown in FIG. 3 in which the toner peeled at a cross portion so that the ground of paper was observed was obtained. Subsequently, a 512-pixel square region of the cross portion was photographed with a CCD camera at a resolution of 800 pixels/inch. The image was binarized with a threshold set to 60%, and the area ratio of the portion from which the toner had peeled, i.e., a white portion was defined as a peel ratio. The smaller the area ratio of the white portion, the greater the difficulty with which the toner peels.

The peel ratio was measured for each fixation temperature, and fixation temperatures and peel ratios were plotted on an axis of abscissa and an axis of ordinate, respectively. The plots were smoothly connected, and the temperature at which the resultant curve intersected a line corresponding to a peel ratio of 10% was defined as a peel temperature.

(Evaluation criteria)

A: The peel temperature is in the range of 90° C. to 110° C.

B: The peel temperature is in the range of 115° C. to 130° C.

C: The peel temperature is in the range of 135° C. to 155° C.

D: The peel temperature is 160° C. or higher.

<Method for Evaluation for Offset Resistance>

The fixed image obtained in the evaluation for fixation starting temperature was evaluated for whether hot offset (phenomenon in which the fixed image adhered from paper to a fixing roller and adhered to paper again after one rotation of the fixing roller) occurred.

The case where the image density of the non-image portion of the image was at least 0.03 time as high as a solid image density was regarded as indicating the occurrence of offset. It should be noted that any such image density was measured with a color reflection densitometer X-RITE 404A (manufactured by X-Rite).

(Evaluation criteria)

A: No hot offset occurs at temperatures up to 180° C.

B: Hot offset occurs at 180° C.

C: Hot offset occurs at 175° C. or 170° C.

D: Hot offset occurs at 165° C. or lower.

<Evaluation for Fine-Line Reproducibility>

Evaluation for fine-line reproducibility was performed from the viewpoint of an improvement in image quality. An image on a 50,000-th sheet output in the following evaluation for durable stability was evaluated for fine-line reproducibility. The output resolution of a full-color copying machine CLC5000 (manufactured by Canon Inc.) is 400 dpi, so a 2-pixel line has a theoretical width of 127 μm. The line width of the image was measured with a microscope (VK-8500 manufactured by KEYENCE CORPORATION), and L represented by the following equation was defined as a fine-line reproducibility index on condition that the measured line width was represented by d (μm).

$$L(\mu m) = |127 - d|$$

L defines a difference between a theoretical line width of 127 μm and the line width d on the output image. L is represented, as the absolute value of the difference because d may be larger than or smaller than 127. The image exerts more excellent fine-line reproducibility with decreasing L.

(Evaluation Criteria)

A: L is less than 3 μm.

B: L is 3 μm or more and less than 10 μm.

C: L is 10 μm or more and less than 20 μm.

D: L is 20 μm or more.

<Method for Evaluation for Durable Stability>

An image (having a print area ratio of 4%) in which a lattice pattern having a line width of 2 pixels had been printed on the entire surface of A4 paper was printed on up to 50,000 sheets with a full-color copying machine CLC5000 (manufactured by Canon Inc.) reconstructed so as to have a process speed of 320 mm/sec. Toner was evaluated for durable stability on the basis of the number of sheets at the time point when dirt was generated on the image.

(Evaluation Criteria)

A: No dirt is generated at the time point when the image is printed on 50,000 sheets.

B: Dirt is generated at the time point when the image is printed on 40,000 sheets.

C: Dirt is generated at the time point when the image is printed on 20,000 sheets.

D: Dirt is generated at the time point when the image is printed on 5,000 sheets.

Comparative Example 1

Toner particles were produced in the same manner as in Example 1 except that the liquid toner composition 2 was used instead, of the liquid toner composition 1, and the particles were subjected to an external addition treatment in the same manner as in Example 1, whereby Toner 2 was obtained. Table 4 shows the physical properties of Toner 2 and the results of the evaluation of Toner 2 for electrophotographic performance.

The liquid toner composition 2 used a polyester resin of a linear structure having a Tg of 38° C. as a binder resin so as to achieve an improvement in low-temperature fixability of Toner 2. As a result, Toner 2 showed a Tp of 38° C., a fixation starting temperature of 90° C., and a peel temperature of 90° C.; these results mean that Toner 2 showed excellent low-temperature fixability. However, an increase in amount of resin fine particles with a view to achieving good heat-resistant storage stability led to the following result: Toner 2 showed heat-resistant storage stability at D level. In addition, hot offset occurred at 160° C.; the result means that Toner 2 was poor in offset resistance.

Comparative Example 2

Toner particles were produced in the same manner as in Example 1 except that the liquid toner composition 3 was used instead of the liquid, toner composition 1, and the particles were subjected to an external addition treatment in the same manner as in Example 1, whereby Toner 3 was obtained. Table 4 shows the physical properties of Toner 3 and the results of the evaluation of Toner 3 for electrophotographic performance.

The liquid toner composition 3 used a polyester resin of a crosslinked structure having a Tg of 67° C. and a polyester resin of a linear structure having a Tg of 41° C. as binder resins so as to achieve an improvement in heat-resistant storage stability of Toner 3. As a result, Toner 3 showed a Tp of 63° C.; the result means that Toner 3 showed excellent heat-resistant storage stability (at A level). However, Toner 3 showed, a fixation starting temperature of 145° C. and a peel temperature of 155° C.; these results mean that Toner 3 was poor in low-temperature fixability.

Comparative Example 3

Toner particles were produced in the same manner as in Example 1 except that: the resin fine particles 5 were used instead of the resin fine particles 1; and the amount of the resin fine particles to be loaded was increased from 4 parts by mass to 6 parts by mass with respect to the toner base particles (A), and the particles were subjected to an external addition treatment in the same manner as in Example 1, whereby Toner 4 was obtained. Table 4 shows the physical properties of Toner 4 and the results of the evaluation of Toner 4 for electrophotographic performance. The resin fine particles 5 are each mainly formed of the resin (b) having a high softening point, and each have a Tp' of 136° C. A capsule toner of a structure with a hard, thin surface layer was produced so that compatibility between low-temperature fixability and heat-resistant storage stability was achieved. As a result, Toner 4 showed a Tp of 55° C. and a Ts of 136° C.; these results mean that Toner 4 showed excellent heat-resistant storage stability (at A level). However, Toner 4 showed a fixation starting temperature of 115° C. and a peel temperature of 165° C.; these results mean that Toner 4 was poor in low-temperature fixability. In addition, Toner 4 showed durable stability at C level.

The use of hard resin fine particles in the surface layer may have increased a difference between the fixation starting temperature and the peel temperature. This is probably because of the following reason: the surface layer melts imperfectly, so the toner particles do not fuse sufficiently, and the toner is imperfectly fixed.

Comparative Example 4

Toner particles were produced in the same manner as in Example 1 except that: the vinyl resin fine particles 3 (Table 2) were used instead of the urethane-containing resin fine particles 1; and the amount of the resin fine particles to be loaded was increased from 4 parts by mass to 6 parts by mass with respect to the toner base particles (A), and the particles were subjected to an external addition treatment in the same manner as in Example 1, whereby Toner 5 was obtained.

Table 4 shows the physical properties of Toner 5 and the results of the evaluation of Toner 5 for electrophotographic performance. Toner 5 showed a fixation starting temperature of 90° C., an excellent result (at A level), and a peel temperature of 120° C., a good result (at B level). Toner 5 was poor in heat-resistant storage stability (at C level). In addition, Toner 5 showed, good fine-line reproducibility at an initial stage, but dirt was generated at the time point when such image as described above was printed on 5,000 sheets, so Toner 5 showed durable stability at D level; the result means that Toner 5 was poor in durable stability. This is probably because of the following reason: the surface layer (B) is formed of a vinyl resin, and adhesiveness between the surface layer (B) and the toner base particle (A) is not sufficient, so the extent to which the toner base particle is turned into a capsule is insufficient, and the resultant toner particle cannot respond to stringent printing conditions.

In addition, Toner 5 had a particle size distribution D4/D1 of 1.28, which was inferior to the particle size distribution D4/D1 of Toner 1, i.e., 1.11. Although the reason for the foregoing is not clear, the reason is probably as follows: a vinyl resin fine particle was used, for a polyester toner base particle, so an affinity between the toner base particle (A) and the surface layer (B) reduced at the time of toner granulation.

Comparative Example 5

A toner was produced by a pulverization method as described below.

| | |
|---|---|
| The binder resin (a)-4 | 1,000 parts by mass |
| C.I. Pigment Blue 15:3 | 50 parts by mass |
| An ester wax (having a melting point of 65° C.) | 50 parts by mass |

The above materials were mixed with a HENSCHEL mixer, and the mixture was melted and kneaded with a biaxial extruder. The molten kneaded product was coarsely pulverized with a hammer mill into coarsely pulverized products capable of passing a 1-mm mesh. Further, the coarsely pulverized products were finely pulverized with a jet mill, and the finely pulverized products were classified with a multi-division classifier, whereby toner particles were produced. Subsequently, the particles were subjected to an external addition treatment in the same manner as in Example 1, whereby Toner 6 was obtained. The temperature Ts did not appear in the curve 1 obtained in the temperature-loss modulus plot of Toner 6.

Table 4 shows the physical properties of Toner 6 and the results of the evaluation of Toner 6 for electrophotographic performance. In the comparative example, the binder resin (a)-4 as a crosslinked resin having a Tg of 65° C. was used as a binder resin in order that heat-resistant storage stability might be imparted to Toner 6. As a result, Toner 6 showed good heat-resistant storage stability (at B level). However, Toner 6 showed a fixation starting temperature of 145° C. and a peel temperature of 155° C.; these results mean that Toner 6 was poor in low-temperature fixability.

Comparative Example 6

A toner was granulated by the following method with an inorganic dispersant, whereby a toner free of the surface layer (B) and containing only the toner base particles (A) was produced.

[Preparation of inorganic aqueous dispersion medium]

451 parts by mass of a 0.1-mol/l aqueous solution of $Na_3PO_4$ were charged into 709 parts by mass of ion-exchanged water, and the temperature of the mixture was increased to 60° C. After that, the mixture was stirred with a TK-HOMOMIXER (manufactured by Tokushu Kika Kogyo) at 12,000 rpm, and 67.7 parts by mass of a 1.0-mol/l aqueous solution of $CaCl_2$ were gradually added to the mixture, whereby an inorganic aqueous dispersion medium containing $Ca_3(PO_4)_2$ was obtained.

[Emulsifying and desolvating steps]

| | |
|---|---|
| The above inorganic aqueous dispersion medium | 200 parts by mass |
| A 50% aqueous solution of sodium dodecyl diphenyl ether disulfonate (ELEMINOL MON-7 manufactured by Sanyo Chemical Industries Ltd.) | 4 parts by mass |
| Ethyl acetate | 16 parts by mass |

The above materials were loaded into a beaker, and the mixture was stirred with a TK-HOMOMIXER at 5,000 rpm for 1 minute, whereby the aqueous phase was prepared. 170.5 parts by mass of the liquid toner composition 1 were charged into the aqueous phase, and the mixture was continuously stirred with the TK-HOMOMIXER for 3 minutes while the number of revolutions of the TK-HOMOMIXER was increased to 8,000 rpm. Thus, the liquid toner composition 1 was suspended. A stirring blade was set in the beaker, and the suspension was stirred with the blade at 200 rpm while the temperature in the system was increased to 50° C. The resultant was subjected to desolvation in a draft chamber over 10 hours. Thus, a water dispersion liquid of toner was obtained.

(Washing and drying steps)

The above water dispersion liquid of the toner was filtrated, and the filtrate was charged into 500 parts by mass of ion-exchanged water so that slurry was prepared. After that, while the system was stirred, hydrochloric acid was added to the system until the pH of the system reached 1.5 to dissolve $Ca_3(PO_4)_2$. Then, the mixture was stirred for 5 minutes.

The above slurry was filtrated again, 200 parts by mass of ion-exchanged water were added to the filtrate, and the mixture was stirred for 5 minutes; the operation was repeated three times. As a result, triethylamine remaining in the system was removed, whereby a filtrated cake of the toner was obtained. The above filtrated cake was dried with a warm air at 45° C. for 3 days and sieved with a mesh having an aperture of 75 μm, whereby toner particles were obtained. Subsequently, the particles were subjected to an external addition treatment in the same manner as in Example 1, whereby Toner 7 was obtained. Toner 7 was evaluated for its performance as a color toner in the same manner as in Example 1. Table 4 shows the results of the evaluation.

The temperature Ts did not appear in the curve 1 obtained in the temperature-loss modulus plot of Toner 7. Toner 7 was poor in heat-resistant storage stability (at D level).

Comparative Example 7

Toner particles were produced in the same manner as in Example 1 except that the liquid toner composition 6 was used instead of the liquid toner composition 1, and the particles were subjected to an external addition treatment in the same manner as in Example 1, whereby Toner 8 was obtained. Table 4 shows the physical properties of Toner 8 and the results of the evaluation of Toner 8 for electrophotographic performance.

Toner 8 showed excellent heat-resistant storage stability, (at B level), and showed, good results for a fixation starting temperature and a peel temperature: a fixation starting temperature of 110° C. (at B level) and a peel temperature of 120° C. (at B level). Toner 8 showed good fine-line reproducibility at an initial stage, but was poor in durable stability (at D level). This is probably because of the following reason: the toner base particle (A) and the surface layer are formed of a vinyl resin and a urethane-containing resin, respectively, and adhesiveness between the surface layer (B) and the toner base particle (A) is not sufficient under severe printing conditions.

Example 2

Toner particles were produced in the same manner as in Example 1 except that: the liquid toner composition 4 was used instead of the liquid toner composition 1; the resin fine particles 4 were used instead of the resin fine particles 1; and the amount of the resin fine particles to be loaded was decreased from 4 parts by mass to 3 parts by mass with respect to the toner base particles (A), and the particles were subjected to an external addition treatment in the same manner as in Example 1, whereby Toner 9 was obtained. Table 4 shows the physical properties of Toner 9 and the results of the evaluation of Toner 9 for electrophotographic performance.

A toner having a relatively small particle diameter was obtained because the liquid toner composition 4 had a slightly higher acid value than that of the liquid toner composition 1, and was more excellent in granulating performance than the liquid toner composition 1. In contrast to the resin fine particles 1, the resin fine particles 4 were each mainly formed of the resin (b) having a high Tp', and Toner 9 showed a Tp of 59° C. and a Ts of 88° C.: a difference between Tp and Ts was 29° C. Toner 9 showed excellent heat-resistant storage stability (at A level), and showed a fixation starting temperature of 110° C. and a peel temperature of 130° C.; these results mean that Toner 9 showed good low-temperature fixability. Additionally reducing the difference between Tp and Ts may be able to lower the peel temperature additionally.

Example 3

Toner particles were produced in the same manner as in Example 1 except that: the liquid toner composition 5 was used instead of the liquid toner composition 1; and the amount of the resin fine particles 1 to be loaded was decreased from 4 parts by mass to 3 parts by mass with respect to the toner base particles (A), and the particles were subjected to an external addition treatment in the same manner as in Example 1, whereby Toner 10 was obtained. Table 4 shows the physical properties of Toner 10 and the results of the evaluation of Toner 10 for electrophotographic performance. The resultant toner had a G'130 of less than $1.0\times10^2$ Pa. The toner showed a fixation starting temperature of 90° C., a value at A level, and a peel temperature of 100° C. (at A level); these results mean that the toner exerted excellent low-temperature fixability. Further, the toner showed good heat-resistant storage stability. Hot offset occurred at 170° C., but the toner showed offset resistance at such a level that no problems arose in practical use. This is probably because G'130 showing elasticity at a fixing nip is low. The toner showed durable stability at B level.

Comparative Example 8

Toner particles were produced in the same manner as in Example 1 except that the amount of the resin fine particles 1 to be loaded was decreased from 4 parts by mass to 0.8 part by mass with respect to the toner base particles (A), and the particles were subjected to an external addition treatment in the same manner as in Example 1, whereby Toner 11 was obtained. Table 4 shows the physical properties of Toner 11 and the results of the evaluation of Toner 11 for electrophotographic performance.

When the usage of the surface layers (B) with respect to 100 parts by mass of the toner base particles (A) was less than 1.0 part by mass, the following result was obtained: Toner 11 was slightly inferior in heat-resistant storage stability, and considerably inferior in durable stability, to Toner 1 of Example 1. In addition, the weight average particle diameter (D4) of the toner was 6.3 μm, which was slightly larger than that of Toner 1, i.e., 5.6 μm, and, furthermore, the particle size distribution (D4/D1) of the toner was 1.26, in other words, the particle size distribution broadened as compared to that of Toner 1, i.e., 1.11. Those results show that the toner base particles were turned into capsules, but uniform toner particles could not be produced. Those results may be attributable to the shortage of the amount of the resin fine particles of which the surface layers were formed to be loaded.

Example 4

Toner 12 was produced in the same manner as in Example 1 except that: the resin fine particles 2 (fine particles each formed of a polyester resin) were used instead of the resin fine particles 1; and the amount of the resin fine particles to be loaded was increased from 4 parts by mass to 6 parts by mass with respect to the toner base particles (A), and the particles were subjected to an external addition treatment in the same manner as in Example 1, whereby Toner 12 was obtained. Table 4 shows the physical properties of Toner 12 and the results of the evaluation of Toner 12 for electrophotographic performance.

The toner exerted excellent performance in terms of both heat-resistant storage stability and low-temperature fixability. However, the toner had a particle size distribution (D4/D1) of 1.19, which was inferior to that in Example 1, i.e., 1.11.

Examples 5 and 6

In each of Examples 5 and 6, toner particles were produced in the same manner as in Example 1 except that the amount of the resin fine particles 1 to be loaded was increased from 4 parts by mass to an amount shown in Table 3 with respect to the toner base particles (A), and the particles were subjected to an external addition treatment in the same manner as in Example 1, whereby each of Toners 13 and 14 was obtained. Table 4 shows the physical properties of each of Toners 13 and 14 and the results of the evaluation of each of Toners 13 and 14 for electrophotographic performance.

An increase in amount of the surface layers (B) led to the following result: each of the toners showed a good result for a peel temperature, though the peel temperature was slightly inferior to that in Example 1.

Example 7

Toner particles were produced in the same manner as in Example 1 except that the following changes were made in the (emulsifying and desolvating steps) of Example 1, whereby Toner 15 was obtained.

| | |
|---|---|
| Ion-exchanged water | 148 parts by mass |
| The dispersion liquid of the resin fine particles 2 | 26 parts by mass |
| The dispersion liquid of the resin fine particles 3 (In each liquid, 3 parts by mass of the resin fine particles were loaded with respect to 100 parts by mass of the toner base particles (A).) | 26 parts by mass |
| A 50% aqueous solution of sodium dodecyl diphenyl ether disulfonate (Eleminol MON-7 manufactured by Sanyo Chemical Industries Ltd.) | 23 parts by mass |
| Ethyl acetate | 18 parts by mass |

Toner 15 is a toner using a vinyl resin fine particle and a polyester resin fine particle in combination in the resin (b). Table 4 shows the physical properties of Toner 15 and the results of the evaluation of Toner 15 for electrophotographic performance. Toner 15 showed good performance in terms of each of offset resistance, fine-line reproducibility, and durable stability, though each of the offset resistance, fine-line reproducibility, and durable stability of Toner 15 was at 3 level, and was hence slightly inferior to that of Toner 1. Toner 15 showed a particle size distribution D4/D1 of 1.29, which was inferior to that of Toner 1. Therefore, as can be seen from the results of Toner 5 using a vinyl resin fine particle in the resin (b) and Toner 12 using a polyester resin fine particle in the resin (b), the composition of the resin (b) is preferably uniform in order that the particle sizes of the particles of the toner may be uniformized.

Example 8

Toner particles were produced in the same manner as in Example 1 except that: the resin fine particles 4 were used instead of the resin fine particles 1; and the amount of the resin fine particles to be loaded was increased from 4 parts by mass to 7 parts by mass with respect to the toner base particles (A), and the particles were subjected to an external addition treatment in the same manner as in Example 1, whereby Toner 16 was obtained. Table 4 shows the physical properties of Toner 16 and the results of the evaluation of Toner 16 for electrophotographic performance.

Toner 16 exerted excellent performance in terms of both heat-resistant storage stability and low-temperature fixability. The resin fine particles 4 used in Toner 16 each have a temperature Tp' higher than that of each of the resin fine particles 1 by 26° C. Probably by reason of the foregoing, Toner 16 showed a higher value for Ts than that of Toner 1, and showed a fixation starting temperature at B level and a peel temperature at B level. Toner 16 exerted excellent performance in terms of any other parameter except those described above as in the case of Toner 1.

Example 9

| | |
|---|---|
| Toner 17 was produced by an interfacial polymerization as described below. A polyester resin having a number average molecular weight of about 2,000 (acid value: 2 mg/KOH/g, hydroxyl value: 19 mgKOH/g) obtained from an alcohol mixture prepared by mixing 1,3-propanediol, ethylene glycol, and 1,4-butanediol at a ratio of 50 mol %, 40 mol %, and 10 mol %, respectively, and an acid mixture prepared by mixing terephthalic acid and isophthalic acid at a ratio of 50 mol % and 50 mol %, respectively | 95 parts by mass |
| 1,4-butanediol | 20 parts by mass (0.22 part by mol) |
| Dimethylolpropanoic acid | 85 parts by mass (0.63 part by mol) |
| 3-(2,3-dihydroxypropoxy)-1-propanesulfonic acid | 5 parts by mass (0.02 part by mol) |

The above materials were dissolved in 500 parts by mass of acetone. Subsequently, 250 parts by mass (1.12 parts by mol) of isophorone diisocyanate were added to the solution, and the mixture was subjected to a reaction at 60° C. for 4 hours. 64parts by mass (0.63 part by mol) of triethylamine for neutralizing the carboxyl group of dimethylolpropanoic acid were loaded into the above reaction product, and the mixture was stirred. A solution of a polyester resin having isocyanate groups at both of its terminals in acetone (having a solid content ratio of 51%) was obtained.

[Emulsifying and desolvating steps]

| [Emulsifying and desolvating steps] | |
|---|---|
| Ion-exchanged water | 157 parts by mass |
| The dispersion liquid of the resin fine particles 1 | 42 parts by mass |
| A 50% aqueous solution of sodium dodecyl diphenyl ether disulfonate (ELEMINOL MON-7 manufactured by Sanyo Chemical Industries Ltd.) | 24 parts by mass |
| Ethyl acetate | 18 parts by mass |
| 10% ammonia water | 30 parts by mass |
| 1,4-butanediamine | 17 parts by mass |

The above materials were loaded into a beaker, and the mixture was stirred with a TK-HOMOMIXER (manufactured by Tokushu Kika Kogyo) at 2,000rpm for 1 minute, whereby an aqueous phase was prepared.

Subsequently, 160 parts by mass of the liquid toner composition 7 were charged into the aqueous phase, and the mixture was continuously stirred with the TK-HOMOMIXER for 1 minute while the number of revolutions of the TK-HOMOMIXER was increased to 8,000 rpm. Thus, the liquid toner composition 7 was suspended. Subsequently, a stirring blade was set in a separable flask with a cap, and the suspension was stirred with the blade at 100 rpm so that the surface layer (B) was formed on the surface of each of the toner base particles (A) at 50° C. over 8hours by a reaction between an isocyanate and an amine. After the reaction, the resultant was cooled to room temperature, whereby toner dispersion liquid was obtained.

(Washing and drying steps)

The above dispersion liquid of the toner was filtrated, and the filtrate was charged into 500 parts by mass of ion-exchanged water so that slurry was prepared. After that, while the system was stirred, hydrochloric acid was added to the system until the pH of the system reached 4. Then, the mixture was stirred for 5 minutes. The above slurry was filtrated again, 200 parts by mass of ion-exchanged water were added to the filtrate again, and the mixture was stirred for 5 minutes; the operation was repeated three times. As a result, ammonia, 1,4-butanediol, and triethylamine remaining in the slurry and toner were removed, whereby a filtrated cake of the toner particles was obtained.

The above filtrated cake was dried with a vacuum dryer at normal temperature for 3 days and sieved with a mesh having an aperture of 75 μm, whereby toner particles were obtained.

Next, 40 parts by mass of the above toner particles were subjected to an external addition treatment in the same manner as in Example 1, whereby Toner 17 was obtained. Table 4 shows the physical properties of Toner 17 and the results of the evaluation of Toner 17 for electrophotographic performance.

Toner 17 is a toner in which the surface layer (B) has been formed by an interfacial polymerization method. The toner exhibited performance slightly inferior to that of a toner in which the surface layer (B) had been formed of resin fine particles, but the performance was still at a good level.

Example 10

Toner particles 18 were produced in the same manner as in Example 1 except that the resin fine particles 1 were changed to the resin fine particles 6 as shown in Table 3, and the particles were subjected to an external addition treatment in the same manner as in Example 1, whereby Toner 18 was obtained. Table 4 shows the physical properties of Toner 18 and the results of the evaluation of Toner 18 for electrophotographic performance.

None of the resin fine particles 6 used in Toner 18 underwent a diamine elongation reaction. The resin fine particles 6 each had a ratio G"(Tp'+5° C.)/G"(Tp'+25° C.) of 7,400, and hence each showed sharp melt property. Toner 18 using the sharp-melt resin fine particles showed a fixation starting temperature of 95° C. and a peel temperature of 105° C.; these results mean that Toner 18 exerted excellent low-temperature fixability. Further, no offset occurred even when paper was passed at 180° C., so a toner having a wide fixation temperature range was obtained.

Example 11

Toner particles 19 were produced in the same manner as in Example 1 except that the resin fine particles 1 were changed to the resin fine particles 7 as shown in Table 3, and the particles were subjected to an external addition treatment in the same manner as in Example 1, whereby Toner 19 was obtained. Table 4 shows the physical properties of Toner 19 and the results of the evaluation of Toner 19 for electrophotographic performance.

Further, even when the rate at which paper was passed was changed from 280 mm/sec to 360 mm/sec, the results of the evaluation of the toner for fixation starting temperature and the evaluation of the toner for peel temperature were each at A level. Excellent results were obtained probably because the polyester resin 1 having a molecular weight distribution was not used, but a diol having single composition was used in the preparation of the resin fine particles 7. As a result, the ratio G"(Tp'+5° C.)/G"(Tp'+25° C.) of each of the resin fine particles 7 showing the sharp melt property of the resin (b) reached 9,800, which was higher than that of each of the resin fine particles 1, i.e., 3,900. Toner 19 using the resin fine particles 7 showed a fixation starting temperature of 95° C. and a peel temperature of 100° C.; these results mean that Toner 19 exerted excellent low-temperature fixability. This is probably because an improvement in sharp melt property of the toner was attained by virtue of the fact that the sharp melt property of the surface layer (B) was improved as compared to that of Toner 1. Further, no offset occurred even when paper was passed at 180° C., so the acquisition of a toner having a wide fixation temperature range was attained.

TABLE 3

| | | | Toner base particle (A) | | |
|---|---|---|---|---|---|
| | | Production method | Kind of liquid toner composition | Composition and compounding ratio of binder resin (a) | |
| Example 1 | Toner 1 | Dissolution suspension | 1 | Binder resin (a)-1 80% | Binder resin (a)-4 20% |
| Comparative Example 1 | Toner 2 | | 2 | Binder resin (a)-3 100% | — |
| Comparative Example 2 | Toner 3 | | 3 | Binder resin (a)-2 20% | Binder resin (a)-6 80% |
| Comparative Example 3 | Toner 4 | | 1 | Binder resin (a)-1 80% | Binder resin (a)-4 20% |
| Comparative Example 4 | Toner 5 | | | | |
| Comparative Example 5 | Toner 6 | Pulverization | — | — | Binder resin (a)-4 100% |
| Comparative Example 6 | Toner 7 | Dissolution suspension | 1 | Binder resin (a)-1 80% | Binder resin (a)-4 20% |
| Comparative Example 7 | Toner 8 | | 6 | — | Binder resin (a)-8 100% |
| Example 2 | Toner 9 | | 4 | Binder resin (a)-2 30% | Binder resin (a)-4 70% |
| Example 3 | Toner 10 | | 5 | Binder resin (a)-7 40% | Binder resin (a)-6 60% |
| Comparative Example 8 | Toner 11 | | 1 | Binder resin (a)-1 80% | Binder resin (a)-4 20% |
| Example 4 | Toner 12 | | | | |
| Example 5 | Toner 13 | | | | |
| Example 6 | Toner 14 | | | | |
| Example 7 | Toner 15 | | | | |
| Example 8 | Toner 16 | | | | |
| Example 9 | Toner 17 | Interfacial polymerization | 7 | Binder resin (a)-1 60% | Binder resin (a)-8 40% |
| Example 10 | Toner 18 | Dissolution suspension | 1 | Binder resin (a)-1 80% | Binder resin (a)-4 20% |
| Example 11 | Toner 19 | | | | |

| | | Surface layer (B) | |
|---|---|---|---|
| | | Kind of resin fine particles | Amount of resin fine particles with respect to 100 parts by mass of toner base particles (A) (parts by mass) |
| Example 1 | Toner 1 | 1 | 4 |
| Comparative Example 1 | Toner 2 | 1 | 12 |
| Comparative Example 2 | Toner 3 | 1 | 4 |
| Comparative Example 3 | Toner 4 | 5 | 6 |

TABLE 3-continued

| | | | |
|---|---|---|---|
| Comparative Example 4 | Toner 5 | 3 | 6 |
| Comparative Example 5 | Toner 6 | Not used | — |
| Comparative Example 6 | Toner 7 | Not used | — |
| Comparative Example 7 | Toner 8 | 1 | 4 |
| Example 2 | Toner 9 | 4 | 3 |
| Example 3 | Toner 10 | 1 | 3 |
| Comparative Example 8 | Toner 11 | 1 | 0.8 |
| Example 4 | Toner 12 | 2 | 6 |
| Example 5 | Toner 13 | 1 | 10 |
| Example 6 | Toner 14 | 1 | 16 |
| Example 7 | Toner 15 | 2 + 3 | 3 + 3 |
| Example 8 | Toner 16 | 4 | 7 |
| Example 9 | Toner 17 | 1 | 4.5 |
| Example 10 | Toner 18 | 6 | 4 |
| Example 11 | Toner 19 | 7 | 4 |

TABLE 4

| | | Tp (° C.) | Ts (° C.) | Tg (4.0) (° C.) | Tg (0.5) (° C.) | Tg (4.0) − Tg (0.5) (° C.) | G''(Ts)/ G''(Ts + 5) | G'130 (Pa) | D4 (μm) | D4/D1 |
|---|---|---|---|---|---|---|---|---|---|---|
| Example 1 | Toner 1 | 53 | 71 | 56.9 | 52.4 | 4.5 | 4.1 | $9.3 \times 10^2$ | 5.6 | 1.11 |
| Comparative Example 1 | Toner 2 | 38 | 70 | 41.4 | 38.2 | 3.2 | 3.8 | $2.6 \times 10^2$ | 5.8 | 1.16 |
| Comparative Example 2 | Toner 3 | 63 | 72 | 65.7 | 62.6 | 3.1 | 3.3 | $2.2 \times 10^3$ | 5.7 | 1.16 |
| Comparative Example 3 | Toner 4 | 55 | 136 | 61.1 | 54.3 | 6.8 | 31 | $5.4 \times 10^3$ | 5.8 | 1.21 |
| Comparative Example 4 | Toner 5 | 53 | 78 | 53.8 | 52.5 | 1.3 | 1.9 | $9.8 \times 10^2$ | 6.3 | 1.28 |
| Comparative Example 5 | Toner 6 | 65 | — | 64.6 | 64.1 | 0.5 | — | $1.9 \times 10^3$ | 7.2 | 1.41 |
| Comparative Example 6 | Toner 7 | 52 | — | 53.0 | 51.3 | 1.7 | — | $7.4 \times 10^2$ | 5.9 | 1.23 |
| Comparative Example 7 | Toner 8 | 61 | 71 | 60.5 | 59.1 | 1.4 | 2.4 | $1.0 \times 10^3$ | 6.1 | 1.21 |
| Example 2 | Toner 9 | 59 | 88 | 61.1 | 58.4 | 2.7 | 3.2 | $1.3 \times 10^4$ | 5.2 | 1.13 |
| Example 3 | Toner 10 | 42 | 68 | 45.5 | 41.9 | 3.6 | 3.1 | $8.1 \times 10^1$ | 5.8 | 1.21 |
| Comparative Example 8 | Toner 11 | 52 | 72 | 53.2 | 61.4 | 1.8 | 2.2 | $8.7 \times 10^2$ | 6.3 | 1.26 |
| Example 4 | Toner 12 | 53 | 74 | 56.1 | 52.6 | 3.5 | 3.8 | $9.6 \times 10^2$ | 5.7 | 1.19 |
| Example 5 | Toner 13 | 55 | 75 | 60.3 | 54.5 | 5.8 | 5.1 | $2.1 \times 10^3$ | 5.2 | 1.16 |
| Example 6 | Toner 14 | 56 | 76 | 62.4 | 55.3 | 7.1 | 5.9 | $3.6 \times 10^3$ | 4.9 | 1.17 |
| Example 7 | Toner 15 | 53 | 74 | 55.9 | 51.9 | 4.0 | 3.3 | $8.8 \times 10^2$ | 5.7 | 1.29 |
| Example 8 | Toner 16 | 53 | 82 | 57.0 | 52.7 | 4.3 | 3.9 | $8.7 \times 10^2$ | 5.6 | 1.19 |
| Example 9 | Toner 17 | 59 | 72 | 62.1 | 58.6 | 3.5 | 3.1 | $3.5 \times 10^2$ | 5.5 | 1.22 |
| Example 10 | Toner 18 | 52 | 68 | 54.8 | 51.3 | 3.5 | 3.6 | $9.2 \times 10^2$ | 5.7 | 1.14 |
| Example 11 | Toner 19 | 51 | 73 | 53.7 | 50.4 | 3.3 | 3.7 | $9.0 \times 10^2$ | 6.1 | 1.11 |

| | | Heat-resistant storage stability | Fixation starting temperature | Peel temperature | Offset resistance | Fine-line reproducibility | Durable stability |
|---|---|---|---|---|---|---|---|
| Example 1 | Toner 1 | A | A | A | A | A | A |
| Comparative Example 1 | Toner 2 | D | A | A | D | B | B |
| Comparative Example 2 | Toner 3 | A | D | C | A | B | A |
| Comparative Example 3 | Toner 4 | A | B | D | B | B | C |
| Comparative Example 4 | Toner 5 | C | A | B | B | B | D |
| Comparative Example 5 | Toner 6 | B | D | C | B | D | C |
| Comparative Example 6 | Toner 7 | D | A | A | C | C | B |
| Comparative Example 7 | Toner 8 | B | B | B | B | B | D |
| Example 2 | Toner 9 | A | B | B | A | A | B |
| Example 3 | Toner 10 | B | A | A | C | B | B |

TABLE 4-continued

| | | | | | | | |
|---|---|---|---|---|---|---|---|
| Comparative Example 8 | Toner 11 | C | A | A | B | A | D |
| Example 4 | Toner 12 | A | A | A | A | A | A |
| Example 5 | Toner 13 | A | A | B | A | A | A |
| Example 6 | Toner 14 | A | A | B | A | A | B |
| Example 7 | Toner 15 | A | A | A | B | B | B |
| Example 8 | Toner 16 | A | B | B | A | A | A |
| Example 9 | Toner 17 | B | B | B | B | B | B |
| Example 10 | Toner 18 | A | A | A | A | A | A |
| Example 11 | Toner 19 | A | A | A | A | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-161267, filed Jun. 19, 2007, which is hereby incorporated by reference herein in its entirety.

What is claimed is:

1. A color toner comprising capsule toner particles each having a surface layer (B) mainly formed of a resin (b) on a surface of a toner base particle (A) containing at least a binder resin (a), a colorant, and a wax, wherein:

(1) a temperature Tp at which a curve 1 obtained by plotting a temperature (° C.) on an axis of abscissa and a common logarithm (logG") of a value obtained by dividing a loss modulus G" (Pa) of the color toner by a unit (Pa) of the loss modulus on an axis of ordinate shows a maximum is present, and Tp satisfies a relationship of 40° C.≦Tp≦60° C.;

(2) a temperature Ts at which a curve 2 obtained by differentiating the curve 1 with respect to the temperature twice shows a local minimum is present in a temperature range of Tp+10 (° C.) to Tp+40 (° C.);

(3) when the loss modulus G" at the temperature Ts in the curve 1 is represented by G"(Ts) and the loss modulus G" at a temperature higher than the temperature Ts by 5° C. in the curve 1 is represented by G"(Ts+5), a ratio G"(Ts)/G"(Ts+5) is larger than 3.0;

(4) the binder resin (a) is mainly formed of a polyester resin, and the resin (b) comprises a resin having an ester bond as a bond structure of a main chain; and (5) the resin (b) comprises a product of a reaction between a polyester having alcoholic hydroxyl groups at both terminals and a diisocyanate component.

2. A color toner according to claim 1, wherein the color toner has a storage modulus G' at 130° C. (G'130) of $1.0\times10^2$ Pa or more and $1.0\times10^4$ Pa or less.

3. A color toner according to claim 1, wherein a curve 3 obtained by plotting the temperature (° C.) on an axis of abscissa and a common logarithm (logG") of a value obtained by dividing a loss modulus G" (Pa) of the resin (b) by a unit (Pa) of the loss modulus on an axis of ordinate has a local maximum in a temperature range of higher than 40° C. to 100° C. or lower, and, when a temperature at which the curve 3 shows the local maximum is represented by Tp', Tp' satisfies a relationship of Tp<Tp' ≦Tp+30° C.

4. A color toner according to claim 1, wherein an abundance of the surface layers (B) is 1.0 part by mass or more and 15.0 parts by mass or less with respect to 100 parts by mass of the toner base particles (A).

5. A color toner according to claim 1, wherein the surface layer (B) is formed of resin fine particles each containing the resin (b).

6. A color toner according to claim 1, wherein the toner particles are obtained by:

dispersing, in an aqueous medium in which resin fine particles each containing the resin (b) are dispersed, a solution or dispersion product obtained by dissolving or dispersing at least the binder resin (a), the colorant, and the wax in an organic medium; and removing a solvent from the resultant dispersion liquid to dry the dispersion liquid.

* * * * *